US006530356B2

(12) United States Patent
Inoue et al.

(10) Patent No.: US 6,530,356 B2
(45) Date of Patent: Mar. 11, 2003

(54) ENGINE BLOCK STRUCTURE FOR RECIPROCATING ENGINE

(75) Inventors: Yasushi Inoue, Hiroshima (JP); Takashi Mitsuhara, Hiroshima (JP); Takashi Ohtsuru, Hiroshima (JP); Masako Shinohara, Hiroshima (JP); Arata Matsue, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/968,936

(22) Filed: Oct. 3, 2001

(65) Prior Publication Data

US 2002/0062795 A1 May 30, 2002

(30) Foreign Application Priority Data

Oct. 3, 2000 (JP) ..... 2000-304039
Oct. 3, 2000 (JP) ..... 2000-304056

(51) Int. Cl.[7] ..... F01M 1/00
(52) U.S. Cl. ..... 123/196 R; 123/41.44; 123/41.74; 123/41.1
(58) Field of Search ..... 123/195 R, 196 R, 123/41.1, 41.44, 41.74

(56) References Cited

FOREIGN PATENT DOCUMENTS

JP 10-141154 A 5/1998

*Primary Examiner*—Noah P. Kamen
(74) *Attorney, Agent, or Firm*—Nixon Peabody LLP; Donald R. Studebaker

(57) ABSTRACT

A cylinder block for a multi-cylinder engine is provided with a water jacket partly on an intake side of a row of cylinders and partly on an exhaust side of the row of cylinders and a water guide passage through which cooling water is introduced into the water jacket. The cylinder block is provided with oil return passages each of which extends straight from top to bottom of the cylinder block between each adjacent cylinders. A branch oil return passage branches off from a middle portion of the rearmost oil return passage and extends rearward up. A generally triangular director pillar having a bolt hole, that is defined by first to third side walls, is disposed with the first side wall adjacent to a foremost cylinder placed approximately perpendicularly to a line passing center axes of the foremost cylinder and the bolt hole, an edge line facing the first wall placed in an interface between the water jacket and the water guide passage and the second and third side walls placed so as to direct a cooling water stream partly to the water jacket on the intake side and partly to the water jacket on the exhaust side, respectively.

13 Claims, 15 Drawing Sheets

ENGINE BLOCK STRUCTURE FOR RECIPROCATING ENGINE

BACKGROUND OF THE INVENTION

1. Field of the Invention

The present invention relates to an engine block structure for a reciprocating engine, and, in more particularly, to a structure for a cylinder block of a multi-cylinder engine block that is provided with a water jacket on opposite sides of a raw of cylinders and oil return means for returning an oil for lubrication to oil source means from sliding parts and mechanisms.

2. Description of Related Art

There have been known various multi-cylinder reciprocating engines. Such an engine needs lubrication for the purposes of reducing wear and frictional losses of sliding parts of the engine, improving cooling efficiency of the sliding parts and dispersing impact pressure on the sliding parts. Specifically, an engine oil in an oil pan is sucked up by an oil pump and filtered by an oil filter, it is distributed to a main oil gallery in a cylinder block. The engine oil is distributed as a lubrication oil to sliding parts such as a crankshaft and pistons and mechanisms including sliding parts such as a valve drive mechanism installed to a cylinder head for cooling and lubrication of the sliding parts. The lubrication oil seeps out of the sliding parts and drops and then returns into the oil pan. The lubrication oil distributed to the crankshaft and the pistons escapes from sliding parts of the crankshaft and the pistons and seeps out of the sliding parts and drops directly to the oil pan. However, the lubrication oil distributed to, for example, the valve drive mechanism escapes from sliding parts such as camshafts and tappets and drops on a middle deck of the cylinder head. Then, the lubrication oil flows on the middle deck of the cylinder head and returns to the oil pan through oil return passages extending in both cylinder head and cylinder block.

In the case of a front engine-front drive system that is the mainstream of compact cars, it is general to install a power train from an engine to a differential as one whole transversely in an engine compartment. On the other hand, there are cars employing rear drive systems that provide drivers with satisfactory steering feelings. Such a rear drive car has an engine installed longitudinally in an engine compartment. In light of these circumstances, engines are preferable to be installed in both types of cars with only small or miner changes in structure.

However, in general, while a transverse engine that is installed transversely in the engine compartment places a crankshaft in a horizontal transverse direction, a longitudinal engine that is installed longitudinally in the engine compartment places a crankshaft a little inclined rearward down in most cases because it is accompanied by a transmission behind the engine. That is, there is a difference in inclination between the transverse engine and the longitudinal engine. Accordingly, an adverse influence is exerted on a flow of a lubrication oil in the oil return passages due to the positional difference. For example, in the case where an engine is installed transversely in the engine compartment, in order to cause a lubrication oil to drop from the cylinder head all around without staying in the cylinder head and to return to the oil pan, it can be thought to arrange a plurality of oil return passages at proper intervals along a straight row of cylinders. However, if this engine is installed longitudinally in the engine compartment, the lubrication oil is apt to stay near the rear end of the engine. Stagnation of a lubrication oil flow that occurs due to a stay of the lubrication oil is possibly one of causes of seizure of the sliding parts due to breaking of oil films.

In this regard, it can be thought to provide the cylinder head and/or the cylinder block with additional oil return passages at their rear end portions. However, it is very hard for the cylinder block to have oil return passages having desired sizes and shapes at the rear end portion. This is because, in light of providing an entire power train with a sufficient rigidity, the additional oil return passages exert a rigid restraint on a structure of the rear end portion of the cylinder block in which a coupling mount to which a transmission is coupled is.

Further, some engine block has a cylinder block provided with a water jacket that surrounds a straight row of cylinders of an in-line cylinder engine. In this cylinder block, as disclosed in, for example, Japanese Unexamined Patent Publication No. 10-141154, the water jacket comprises two parts of water jacket, an intake side water jacket and an exhaust side water jacket, disposed on opposite sides of the straight row of cylinders, respectively, that are connected to each other at front and rear ends thereof by front and rear communication channels, respectively. Cooling water is introduced into the water jacket through one of the communication channels. A water pump that supplies the cooling water is disposed on one of opposite side walls of the cylinder block near front end of the cylinder block and driven by a crankshaft of the engine through a V-belt.

Generally, in the engine block, cooling water is discharged from the water pump and enters the water jacket through front end of either one part of the water jacket. It is not always easy to appropriately divide a cooling water stream into two parts for the intake side water jacket and the exhaust side water jacket. In this regard, the prior art cylinder block has a water guide passage formed separately from the front communication channel of the water jacket in a front end wall of the cylinder block. According to the prior art cylinder block, cooling water is directed to a front position of the cylinder block through the water guide passage and then introduced into both intake side water jacket and exhaust water jacket. This separate water guide passage makes the cylinder block large in overall length. In addition, although on behalf of providing reliable distribution of cooling water into the intake side water jacket and the exhaust side water jacket, because the prior art cylinder block causes the cooling water stream to sharply turn after a stay at an end of the water guide passage, the distribution of cooling water to the water jacket is hard to be smooth and, in consequence, there possibly occurs an increase in mechanical loss in driving the water pump.

SUMMARY OF THE INVENTION

It is an object of the present invention to provide an engine block structure for a reciprocating engine in which a cylinder block at a rear end portion is provided with oil return passages showing reliable oil returning performance.

It is another object of the present invention to provide an engine block structure for a reciprocating engine including a cylinder block provided with a water jacket surrounding a row of cylinders that has a shortened overall length.

It is another object of the present invention to an engine block structure for a reciprocating engine including a cylinder block provided with a water jacket surrounding a row of cylinders that provides improved performance of introducing and distributing cooling water into a water jacket on opposite sides of the row of cylinders.

The above objects are achieved by an engine block structure including an cylinder block that is provided with a plurality of oil return passages formed along the straight row of cylinders in each of opposite side walls of a cylinder block. Each of the oil return passage extends approximately straight from top to bottom of the cylinder block between each adjacent cylinders so as to reliably return a lubrication oil which is the basic performance of the oil return passage. In addition to the oil return passages, the cylinder block is provided with an auxiliary oil return passage that extends from the rear top of the cylinder block to the middle of the oil return passage with an effect of preventing the lubrication oil from staying in the oil return passage.

According to a preferred embodiment of the invention, in the engine block structure including a cylinder block that is provided with a straight row of cylinders formed with a coupling mount located at a rear end wall of the cylinder block in a lengthwise direction to which a transmission is mounted, oil supply means for supplying an engine oil to sliding parts that are installed to the engine block from oil source means as lubrication oil, and oil return means for returning the lubrication oil to the oil source means from the sliding parts, the oil return means comprises a plurality of oil return passages formed along the straight row of cylinders in each of opposite side walls of the cylinder block, each of which extends straight from top to bottom of the cylinder block between each adjacent cylinders and a branch oil return passage which branches off from one of the oil return passages that is closest to the rear end wall of the cylinder block (a rearmost oil return passage) and extends obliquely upper toward the rear end wall of the cylinder block and opens in the top of the cylinder block. The end opening of the branch oil return passage is located closer to the rear end wall of the cylinder block than the end opening of the rearmost oil return passage opening in the top surface of the cylinder block.

The oil return passage that extends approximately straight from top to bottom of the cylinder block between each adjacent cylinders causes a lubrication oil that seeps out of the sliding parts to smoothly flow through the oil return passage and drop into an oil pan. This provides the engine block with reliable oil returning performance. In addition, while on one hand the arrangement of the oil return passages in which the oil return passage is kept away from positional interference with the cylinders securely provides the oil return passage with a sufficiently large cross sectional area, the arrangement of the oil return passages allows the cylinder block to be compact in configuration. Furthermore, the arrangement of the oil return passages causes the lubrication oil to drop into the oil pan in a position between the adjacent cylinders, so that counterweights of a crankshaft splash about only a small amount of the engine oil in the oil pan.

The branch oil return passage branching off from the rearmost oil return passages that is closest to the rear end wall of the cylinder block and extending obliquely upper toward the rear end wall of the cylinder block prevents the lubrication oil from staying at a rear portion of the cylinder head when the engine, even longitudinally installed in an engine compartment, is inclined with the rear end put lower in vertical position than the front end. Because, although the branch oil return passage has an upstream end opening in the top surface of the cylinder block in close proximity to the end wall of the cylinder block, it joins the oil return passage in a position relatively forward from the upstream end, there is no positional interference between the branch oil return passage and the coupling mount for the transmission.

The cylinder block may further comprise a pit for receiving a pinion of a starter motor therein which is formed so as to open ranging at least from one of the opposite side walls of the cylinder block below the branch oil return passage and to the rear end wall of the cylinder block. This pit is effectively used to enable easy installation of a transmission to the cylinder block. Although, in the case where an cylinder head is formed with the pit ranging from one side wall to the rear wall of the cylinder block, it is practically hard to form such a branch oil return passage as to extend vertically along the rear end of cylinder head because of positional interference with a coupling mount of the cylinder head to which a transmission is mounted, the engine block of the present invention having the branch oil return passage that has the upstream end opening in the top surface of the cylinder block in close proximity to the end wall of the cylinder block and joining the middle of the oil return passage is not exposed to any positional interference between the branch oil return passage and the coupling mount.

The cylinder block is further provided with a water jacket formed partly in one of the opposite sides of the straight row of cylinders and partly in another side of the straight row of cylinders. The branch oil return passage is laid so as to branch off from the oil return passage near below a bottom of the water jacket. According to this arrangement the branch oil return passage is such as to cross the water jacket obliquely as viewed in a vertical direction between the rearmost oil return passage and the rear end of the cylinder block. This structure provides the cylinder with an increased rigidity, which results in an increased coupling strength between the cylinder block and a transmission and a reduction in wall vibration and noise of the engine.

The cylinder block may further comprise a thermostat housing as an integral part of one of the opposite side walls of the cylinder head for receiving a thermostat therein. The thermostat housing is such as to project externally from the side wall in a position close to a front end wall of the cylinder block and corresponding to the water jacket. The cylinder block receives the greatest exciting force in a position corresponding to a combustion chamber of the cylinder, i.e. in a position of the side wall where the water jacket is formed. Accordingly, the cylinder block of the present invention that is formed integrally with the thermostat housing as an integral part of the side wall of the cylinder head is provided with an improved rigidity. This makes it possible to provide the cylinder block with a stiffening rib ranging from the thermostat housing to the rearmost return oil passage in order to increase an overall rigidity of the cylinder block with an effect of reducing wall vibrations.

The cylinder block may further comprise an external raise formed on each of the opposite side walls and an intermediate external raise formed as wall strengthening parts on each of the opposite side walls. The external raise is such as to be adjacent to each of foremost and rearmost oil return passages and the intermediate external raise is such as to continuously lead to both the external raises. The external raise adjacent to the foremost oil return passage is a continuous part of the thermostat housing, and the intermediate external raise is formed with a chamber for receiving an oil separator therein. The cylinder block at an upper portion of the side wall that receives exciting force most hardly is provided with a sufficiently enhanced rigidity by virtue of the integrated structure of the external raises and the thermostat housing as well as the location of the branch oil return passage This prevents or significantly reduces wall vibrations of the side wall of the cylinder block and, as a result, the engine and its associated devices generate only reduced wall vibration and noises. The intermediate external raise is formed with an oil separator chamber therein. The layout of these structural parts of the cylinder block including the thermostat housing, the oil return passages and oil separator chamber realizes a strengthened side wall of the cylinder block, which is contributory to providing the cylinder block having an increased rigidity, a decrease weight and compactness.

The cylinder block that has such a water jacket as extending partly on one side of the straight row of cylinders and partly on another side of the straight row of cylinders may further comprise a water guide passage through which cooling water is introduced into the water jacket at a position adjacent to an extreme or foremost one of the cylinders and director means disposed in the water guide passage near an interface between the water jacket and the water guide passage for directing the cooling water introduced into the water jacket with an effect of causing cooling water to flow smoothly into the water jacket.

Specifically, the director means comprises a generally triangular pillar which extends along an approximately full depth of the water jacket and is formed with a bolt hole in which a head bolt is fastened to install a cylinder head to the cylinder block therein. The triangular pillar is such that first one of three side walls of the triangular pillar that is adjacent to an external wall of the foremost cylinder is approximately perpendicular to a line passing vertical center axes of the foremost cylinder and the bolt hole, an edge line between second and third side walls of the triangular pillar being in the interface, the second side wall operating to direct a cooling water stream partly to the water jacket on one of opposite sides of the straight row of cylinders, and the third side wall directing the cooling water stream partly to the water jacket on another side of the opposite sides of the straight row of cylinders in cooperation with the front end wall of the cylinder block.

The triangular pillar divides a cooling water stream introduced to the water jacket through the water guide passage into two parts on opposite sides of the edge line of the triangular pillar. Then, the second side wall directs one cooling water stream into the water jacket on one side of the straight row of cylinders and the third side wall directs another cooling water stream to the water jacket on another side of the straight row of cylinders in cooperation with the front end wall of the cylinder block. As a result, while the cooling water stream is smoothly introduced into the water jacket, the cooling water stream is appropriately distributed on opposite sides of the straight row of cylinders. In addition, in the case for example where the engine block is provided with a water pump on one of opposite walls of the cylinder block as conventionally, according to the relative position between the edge line of the triangular pillar as director means and the water guide passage, the triangular pillar and the water guide passage overlap in position each other. This layout allows the cylinder block to be comparatively shorter as compared with a layout in which the triangular pillar and the water guide passage are not overlapped in position.

The triangular pillar has the first wall in approximately parallel to the external wall of the foremost cylinder. The cooling water flows between the triangular pillar and the external wall of the foremost cylinder without hindrance, which result in satisfactory cooling performance. The triangular pillar is such that the cross section has a comparatively long distance in a radial direction of the foremost cylinder, so as to have a sufficiently high bending rigidity.

The water guide passage may be formed in one of the opposite side walls of the cylinder block to which an intake manifold is installed so that the water jacket is provided with a width that is greater between the third wall of the triangular pillar and the front end wall of the cylinder block than between the second side wall of the triangular pillar and the intake side wall of the cylinder block. This configuration of the water jacket provides the water jacket with a larger amount of cooling water on the exhaust side at which the cylinder block is exposed to a comparatively high temperature than on the exhaust side. As a result, the cylinder block is entirely cooled by the cooling water flowing through the water jacket.

In the case where the cylinder block is made of aluminum alloy, the triangular pillar is preferably formed with a bolt hole having a depth greater than the depth of the water jacket, and the water guide passage has an upstream end in communication with a pump chamber formed in the cylinder block that receives a water pump therein and a downstream end opening to the water jacket. Further, the water guide passage has a downstream end opening thin over the full depth of the water jacket and preferably has a cross section increasing in area from the upstream end to the downstream end. The water guide passage having an increasing cross sectional area causes cooling water to smoothly flow therethrough. In addition, the water guide passage having the thin downstream end that is thin and opens over the full depth of the water jacket avoids a significant increase in overall length of the cylinder block even though making the end opening as large as possible.

The cylinder block may have a water pump housing in which the pump chamber is formed as an external raise of a front portion of the one side wall of the cylinder block corresponding in position to the water jacket. The thermostat housing, that is formed as an external raise of the one side wall of the cylinder block, is located adjacently behind to the water pump housing. The arrangement in which the water pump is at the front portion of the side wall of the cylinder block makes it possible to drive the water pump by a crankshaft through, for example, a V-belt. Further, the arrangement in which the water pump housing is formed on the side wall of the cylinder block corresponding in position to the water jacket and located adjacently behind the thermostat housing makes the path length of cooling water from the thermostat to the water jacket through the pump chamber comparatively short. This provides an improved performance of introducing cooling water into the water jacket. On the other hand, the arrangement in which the water pump housing and the thermostat housing are formed on the side wall of the cylinder block near the water guide passage exert a constraint on the layout of the water guide passage in such the case that the water guide passage is arranged so as to be free of positional interference with these housings. Despite of the restraint, the engine block structure including the cylinder block described above guarantees the performance of introducing and distributing cooling water into the water jacket.

BRIEF DESCRIPTION OF THE DRAWINGS

The above and other objects and features of the present invention will be clearly understood from the following detailed description when read with reference to the accompanying drawings, in which.

DETAILED DESCRIPTION OF PREFERRED EMBODIMENTS

In this specification the term "rear end" shall mean and refer to an end of an engine block or a cylinder block in a direction of crankshaft axis through which engine torque is output to a transmission, and the term "front end" shall mean and refer to an end of the engine block or the cylinder block opposite to the rear end in the direction of crankshaft axis. Further, the term "front side" or "intake side" shall mean and refer to a side of an engine block or a cylinder block on which an intake manifold is, and the term "rear side" or "exhaust side" shall mean and refer to a side of the engine block or the cylinder block opposite to the front side or the intake side.

Figure 1:
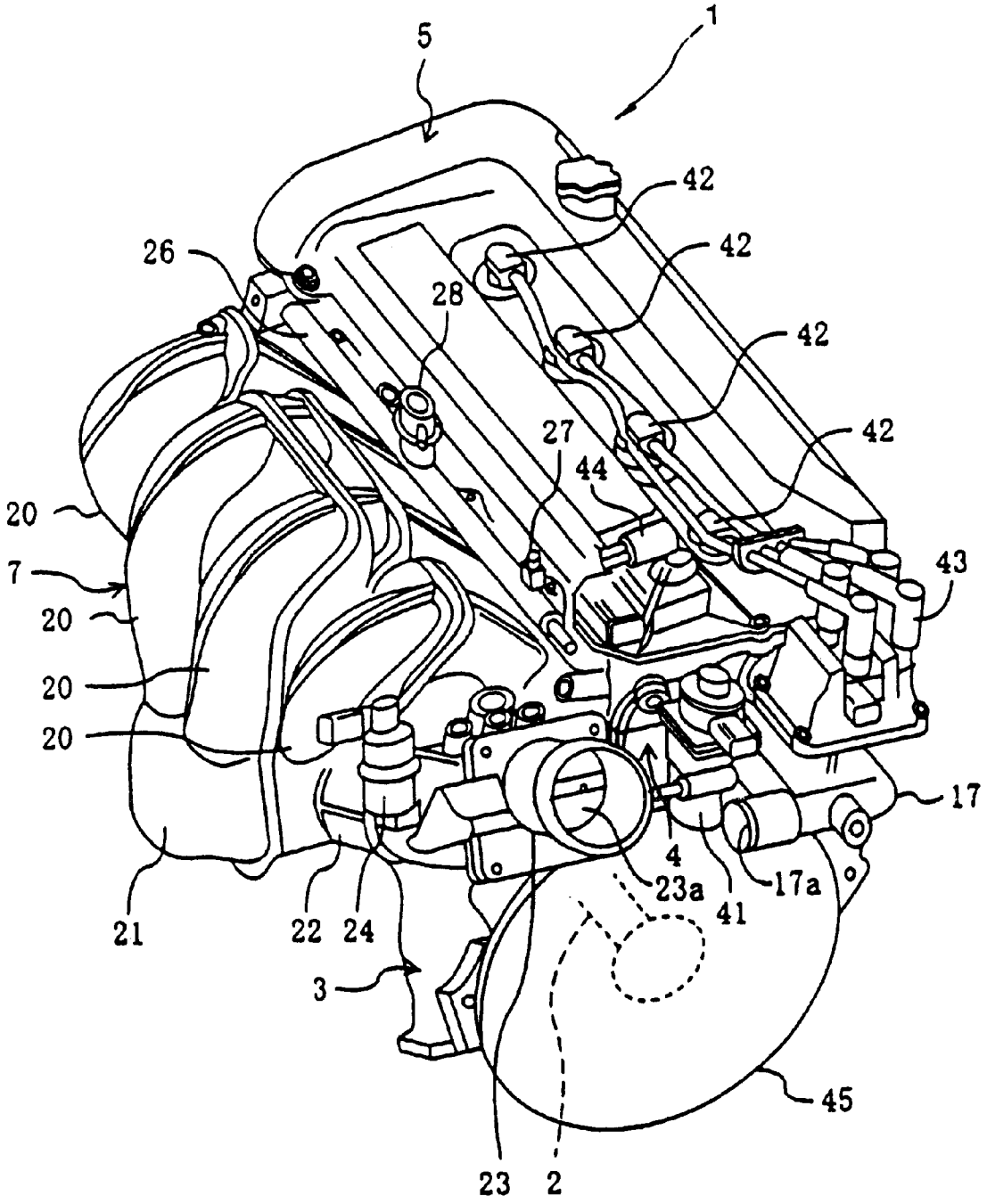
FIG. 1 is a perspective view of an engine including an engine block in accordance with a preferred embodiment of the present invention as viewed from a rear intake side.
Figure 2:
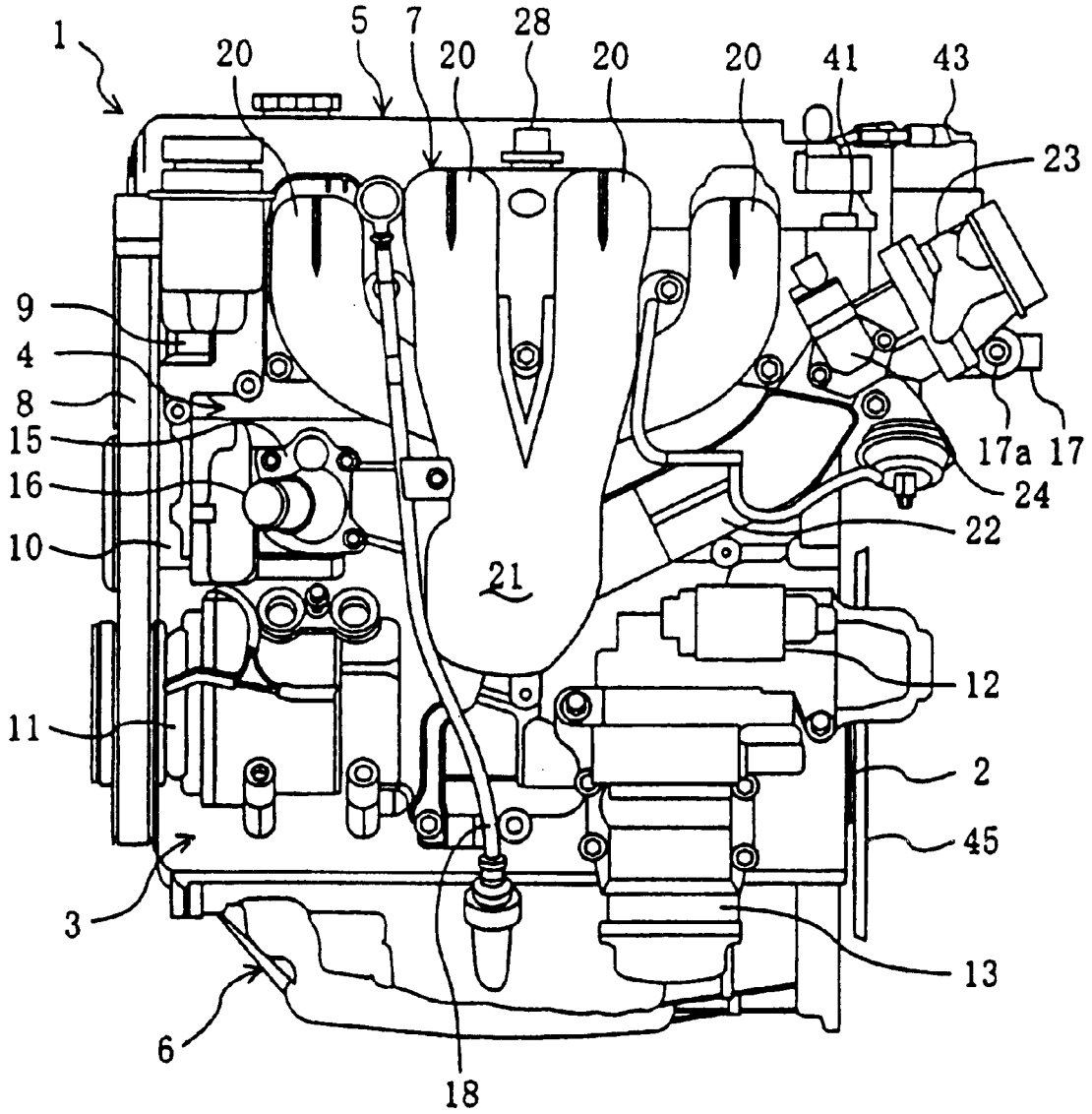
FIG. 2 is a side view of the engine as viewed from an intake side.

Referring to the drawings in detail and, in particular, to FIGS. 1 and 2 which show an engine 1 in accordance with a preferred embodiment of the present invention, the engine 1 is of an in-line four-cylinder type that has a straight row of four cylinders s1–s4 (see FIG. 8) in a direction in parallel to an crankshaft 2 and is disposed in an engine compartment (not shown) so that the crankshaft 2 transversely extends in the engine compartment. The engine 1 has an engine block comprising a cylinder block 3 made of aluminum alloy and a cylinder head 4 made of aluminum alloy. The cylinder head 4 is attached to the cylinder block 3 together. The engine 1 has a cylinder head cover 5 attached to the top of the cylinder head 4 and an oil pan 6 attached to the bottom of the cylinder block 3. The engine 1 is provided with an intake manifold 7 disposed along one of opposite sides or intake side of the engine block. The intake manifold 7 distributes intake air introduced therein into combustion chambers of the respective cylinders s1–s4. There are various supplemental devices, such as a power steering pump 9, a water pump 10 and an air conditioning compressor 11, which are disposed at the front intake side of the engine block. These pumps and compressor 9, 10 and 11 are driven by a V-belt 8. Further, there are other supplemental devices, such as a starter motor 12 and an oil filter 13, which are disposed at a rear intake side of the engine block.

A thermostat housing 15 is located behind the water pump 10 and attached to the engine block on the intake side. This thermostat housing 15 is closed by a cover formed as an integral part of a water supply pipe 16. A flexible water hose (not shown) is connected between the water supply pipe 16 and a radiator (not shown). Cooling water is introduced into a water jacket w (see FIGS. 8 and 13) formed in the cylinder block 3 from the radiator through the water hose and the water supply pipe 16. A drain structure 17 having a drain pipe 17*a* is attached to the rear intake side of the engine block. A flexible water hose (not shown) is connected between the drain pipe 17*a* and the radiator. Cooling water coming out of the water jacket w is drained through the drain pipe 17*a* and returned into the radiator through the water hose. The reference sign 18 denotes a level gauge for checking a level of oil in the oil pan 6.

The intake manifold 7 comprises a plurality of parts welded, or otherwise secured, to one another. Each part is preferably molded out of a material predominantly comprising polyamide resins by injection. Specifically, the intake manifold 7 comprises four branched pipes 20 that are smooth with gentle curves. Each branched pipe 20 at a downstream end is formed with a flange (not shown) through which the branched pipe 20 is bolted or otherwise secured to the front wall 4*a* of the cylinder head 4. The respective branched pipe 20 at upstream ends are united to a common intake pipe 22 extending straight upper left. There is a surge tank 21 between the branched pipes 20 and the common intake pipe 22. The common intake pipe 22 is provided with a throttle valve 23 and an idle speed control (ISC) valve 24 in order from the upstream end. The throttle valve 23 regulates the amount of fresh air that is introduced in through an air filter (not shown). The ISC valve 24, which comprises a magnetic valve, regulates the amount of fresh air that flows bypassing the throttle valve 23. The common intake pipe at a side opposite to a side where the ISC valve 24 is attached 22 is installed to a front wall 4*a* of the cylinder head 4 by a support (not shown). This supporting structure reliably secures the throttle valve 23 and the ISC valve 24.

There is provided a fuel distribution pipe 26 (see FIG. 1) in close proximity to upper portions of the branched pipes 20 such as to extend in parallel to the crankshaft 2 of the engine 1 and perpendicularly to the branched pipes 20. The fuel distribution pipe 26 at the rear end is connected to a fuel hose (not shown). Fuel is distributed to fuel injectors (not shown) for the respective cylinders s1–s4 through the fuel distribution pipe 26. The distribution pipe 26 is provided with a pressure sensor 27 operative to detect a fuel pressure in the fuel distribution pipe 26 and a relief valve 28 operative to relieve and return fuel at a pressure higher than a specific level into a fuel tank (not shown). As seen in FIG. 1, the engine 1 is provided with an angle sensor 44 operative to detect a rotational angle of an intake cam of a valve drive mechanism and a drive plate 45 that is fixedly connected between the crankshaft 2 and a torque converter of an automatic transmission (not shown) so as to transmit torque from the engine 1 to the automatic transmission.

Figure 3:
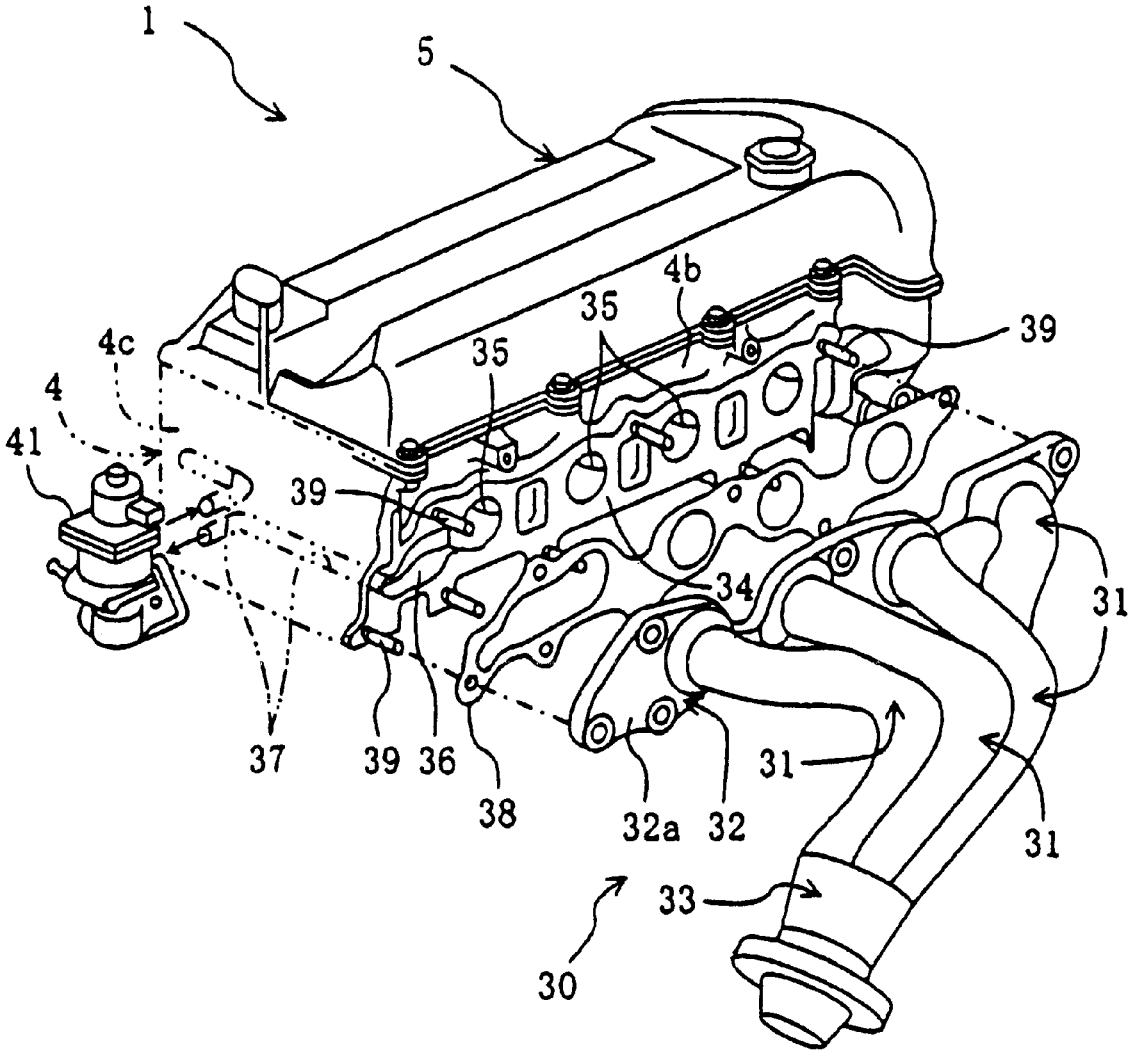
FIG. 3 is a perspective view of the engine as viewed from a front exhaust side.

Referring to FIG. 3, the engine 1 is provided with an exhaust manifold 30 disposed along another side or exhaust side of the engine block. The exhaust manifold 30 comprises four branched pipes 31 equal in length to one another and a fitting flange plate 32 welded or otherwise secured to upstream ends of the respective branched pipes 31. The branched pipes 31 at their downstream ends are united to a joint pipe 33. The branched pipe 31 is made of a curved thin-walled round stainless pipe. The fitting flange plate 32 is made by press forming. The cylinder head 4 is formed with a fitting mount 34 extending along the rear wall 4*b* from the front end to the rear end of the cylinder head 4. Exhaust ports 35, which are in communication with the combustion chambers of the cylinders s1–s4, respectively, are arranged in a straight line and open in the fitting mount 34. The cylinder head 4 at the rear wall 4*b* is formed with a recessed channel 36 open in the fitting mount 34. The recessed channel 36 is located in close proximity to the exhaust port 35 for the fourth cylinder s4 that is closest to the front end of the engine block. The cylinder head 4 at the rear end wall 4*c* is formed with an exhaust gas recirculation (EGR) channel 37. This EGR channel 37 at the upstream end opens near the rear end of the rear wall 4*b* of the cylinder head 4 and is in communication with the recessed channel 36. That is, the recessed channel 36 opens in the surface of the fitting mount 34 at the rear wall 4*b* of the cylinder head 4 and interconnects the EGR channel 37 and the exhaust port 35 for the fourth cylinder s4 so that the exhaust gas can be partly recirculated into the intake manifold 7 from the exhaust port 35 for the fourth cylinder s4. The fitting flange plate 32 lies on the fitting mount 34 through a gasket 38 and is secured to the fitting mount 34 by stud bolts 39 so as to join the exhaust manifold 30 and the cylinder head 4 together. The fitting flange plate 32 is formed with an extension 32*a* at the rear end so as to cover the open end of the EGR channel 37 and the recessed channel 36. This configuration forms an exhaust gas feed chamber between the exhaust port 35 for the fourth cylinder s4 and the EGR channel 37. The exhaust manifold 30 is connected to a common exhaust pipe (not shown) through the joint pipe 33. This exhaust pipe comprises a metal pipe extending to a catalytic converter under the floor of the vehicle.

The cylinder head 4 at the rear end wall 4*c* is provided with an exhaust gas recirculation valve (EGR) 41 operative to control the amount of exhaust gas that is permitted into the intake manifold 7 through the EGR channel 37. This EGR valve 41, which is of a type having a valve body that is actuated by a stepping motor so as to control the amount of exhaust gas recirculation, is located such as to be adjacent to the drain structure 17 at the rear end wall 4*c* of the cylinder head 4 and surrounded by the flexible water hose connected to the drain pipe 17*a*. There are ignition coils 43 that supply high voltages to spark plugs 42 in the respective cylinders s1–s4. This aggregated arrangement of these EGR valves 41 and the ignition coils 43 near the drain structure 17 prevents the EGR valves 41 and the ignition coils 43 from overheating.

Figure 4:
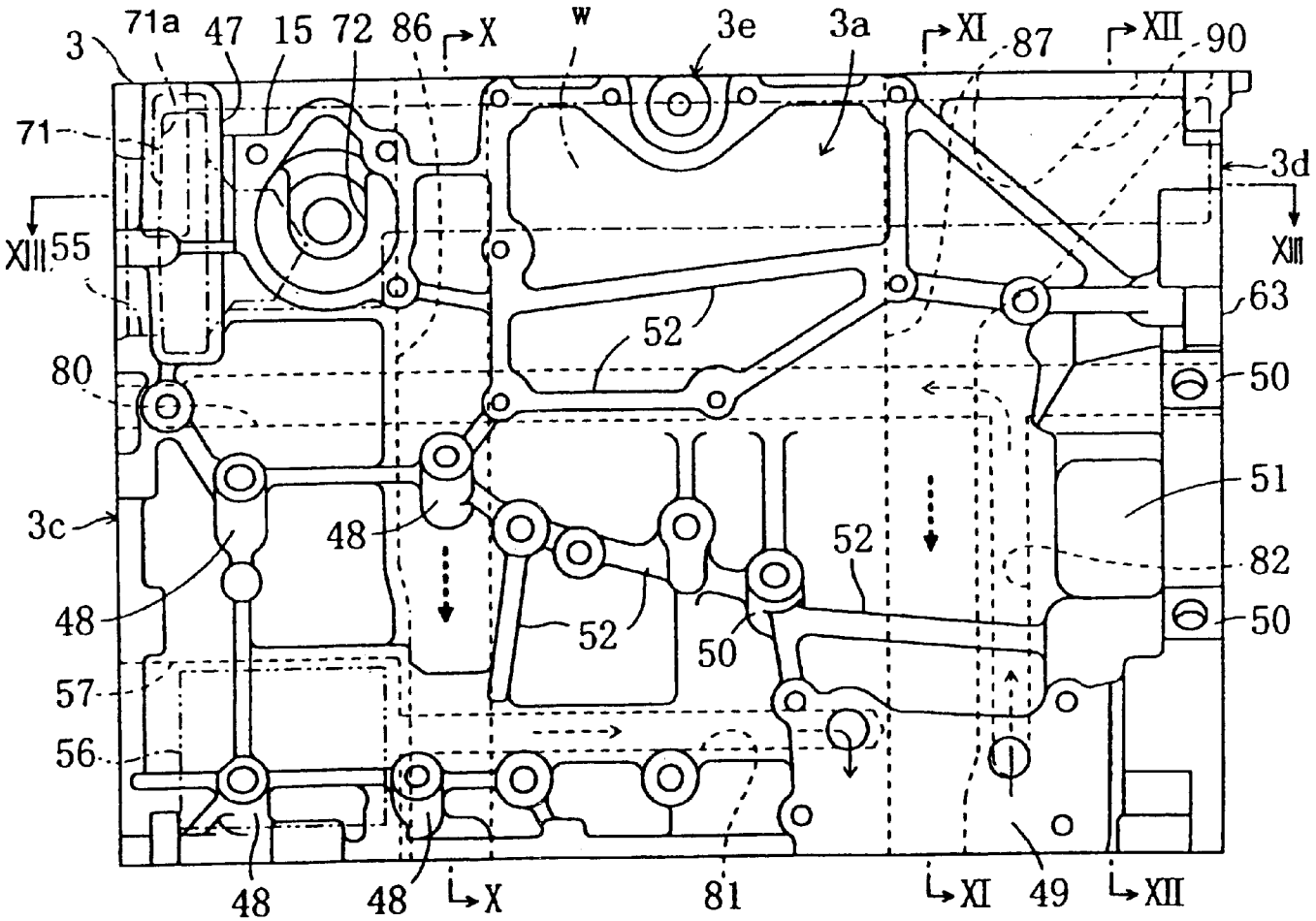
FIG. 4 is a side view of a cylinder block as viewed from an intake side.
Figure 5:
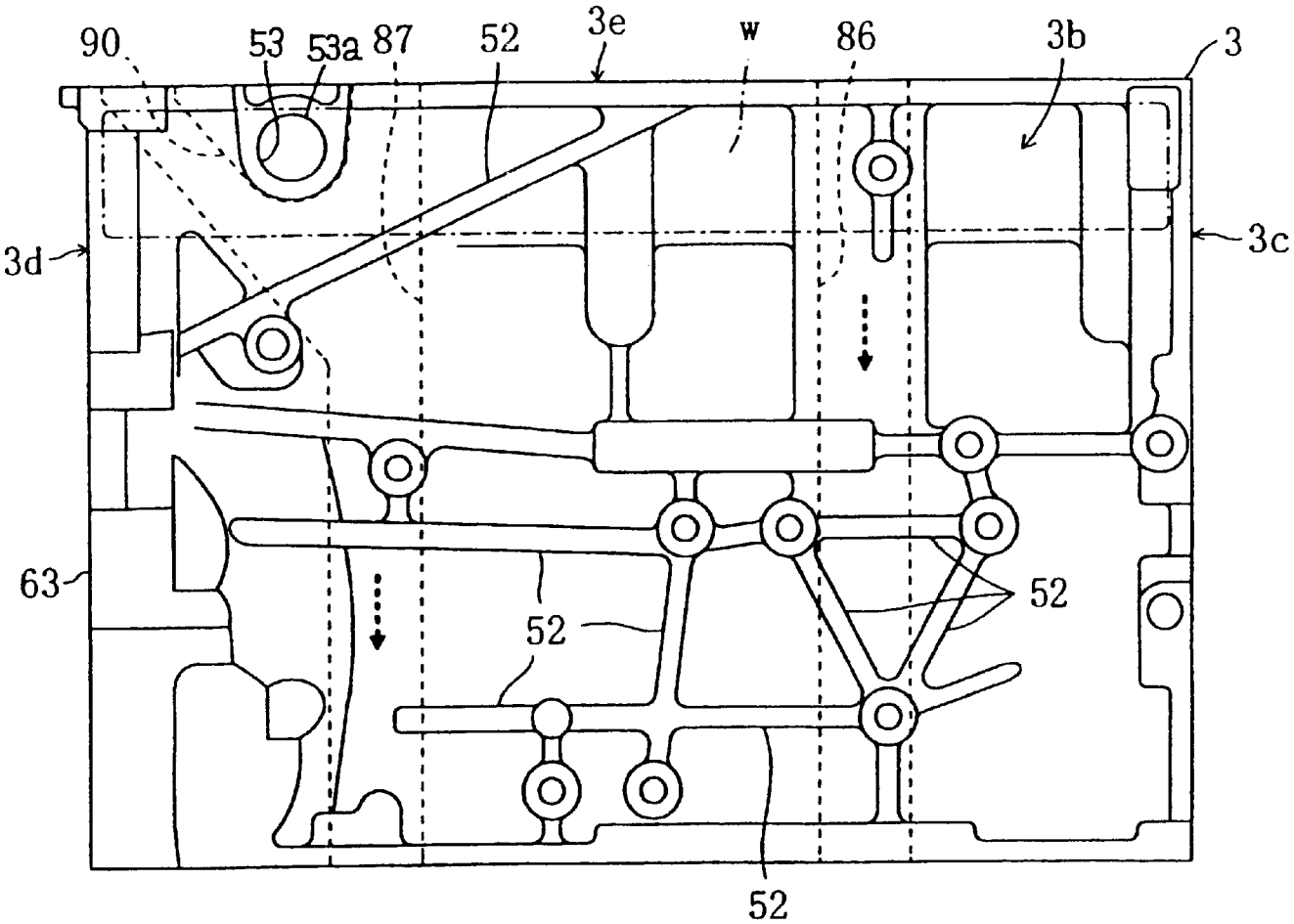
FIG. 5 is a side view of the cylinder block as viewed from an exhaust side.

FIGS. 4 to 9 show the cylinder block 3 with all of the supplemental devices such as the intake manifold 7 and the water pump 10 removed therefrom. As seen in FIG. 4 showing the cylinder block 3 as viewed from the intake side of the engine 1, the cylinder block 3 has a water pump housing 47 for receiving a water pump 10 that is formed near the upper right portion of the cylinder block 3 such as to project laterally from an intake side wall 3*a* of the cylinder block 3. The water pump housing 47 receives the water pump 10 therein. The cylinder block 3 further has a sensor housing 15 formed at the back of the water pump housing 47. The sensor housing 15 receives a thermostat (not shown) therein. These laterally projecting housings 47 and 15 are located corresponding to a position where the water jacket w is formed as will be described later. The cylinder block 3 is formed with fitting bosses 48 such as to extend from the intake side wall 3*a* along the lower edge of the cylinder block 3 below the housings 47 and 15. The cylinder block 3 has a fitting mount 49 that is formed near the lower left portion of the cylinder block 3 such as to project laterally from the intake side wall 3*a* of the cylinder block 3. The oil filter 13 is installed onto the fitting mount 49. The cylinder block 3 is further formed with fitting bosses 50 such as to extend from the intake side wall 3*a* above the fitting mount 49 and a pit 51 such as to open ranging from the intake side wall 3*a* to the rear end wall 3*d*. The starter motor 12 is installed to the fitting bosses 50. The pit 51 receives a pinion (not shown) of the starter motor 12. As seen in FIG. 4 and also in FIG. 5 showing the cylinder block 3 as viewed from the exhaust side of the engine 1, the cylinder block 3 is formed with stiffening ribs 52 formed on the intake side wall 3*a* and the exhaust side wall 3*b*, respectively, so as to stiffen the intake side wall 3*a* and the exhaust side wall 3*b*, respectively. Further, as seen in FIG. 5, the cylinder block 3 is formed with a heater bore 53 formed in the exhaust side wall 3*b* and closed by a plug 53*a*. The heater bore 53 is used to install a heater into the water jacket w. This heater is employed when the engine is for cold district use.

Figure 6:
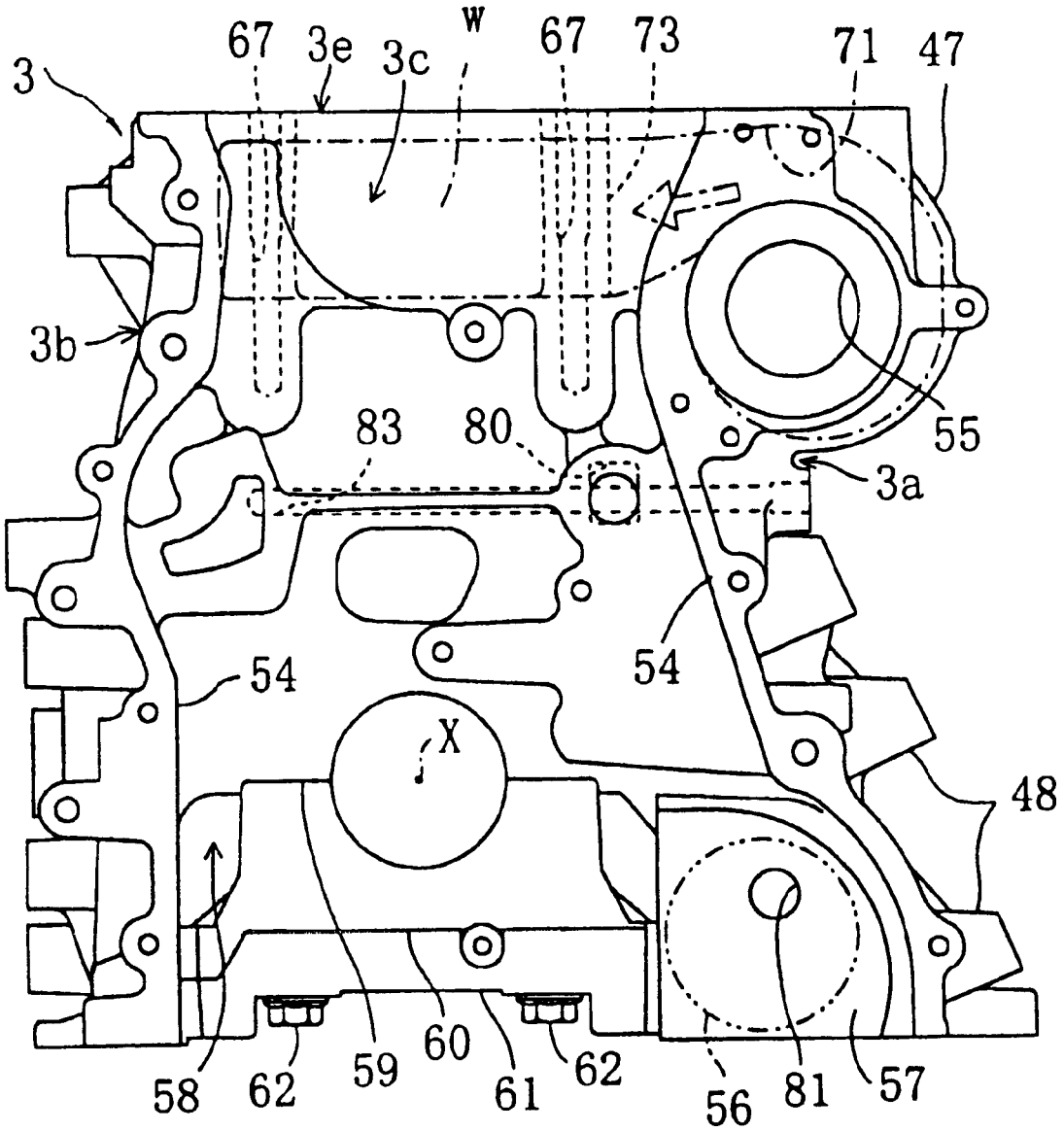
FIG. 6 is a front end view of the cylinder block.

As shown in FIG. 6, the cylinder block 3 at the front end wall 3*c* is formed with locating ribs 54. The locating ribs 54 extend from top to bottom of the cylinder block 3 along opposite sides of the cylinder block 3, respectively. An end cover (not shown) is attached to the locating ribs 54. This fitting structure provides a space for a timing belt of the valve drive mechanism between the cylinder head 3 and the end cover. One of the locating ribs 54, namely the locating rib 54 adjacent to the intake side wall 3*a* of the cylinder block 3, is formed with a circular opening at upper part. This circular opening is in communication with a pump chamber 55 of the water pump housing 47 in which the water pump 10 is received. Further, the locating rib 54 adjacent to the intake side wall 3*a* of the cylinder block 3 is formed with a quadrant opening 57 as a pump housing at lower portion. This quadrant opening 57 is located on one of opposite sides of the locating rib 54 far from the intake side wall 3*a* of the cylinder block 3 and receives an oil pump 56 therein.

The cylinder block 3 is of a deep skirt type that has a skirt formed as an extension of each of the intake side wall 3*a* and the exhaust side wall 3*b* and extending below an axis of rotation X of the crankshaft 2. These skirts from a crankcase 58 therebetween at the bottom of the cylinder block 3 in which the crank shaft 2 is received. There are five main bearings 59 (see FIG. 9) as integral parts of the cylinder block 3 that are arranged in an axial direction of the crankshaft 2 so as to support the crankshaft 2 in the crankcase 58 for rotation. Each of the main bearings 59 is provided with a bearing cap 60. Five bearing caps 60 are connected to a bearing beam 61 as one whole and secured to the main bearings 59 by securing the bearing beam 61 to the main bearings 59 with bolts 62.

Figure 7:
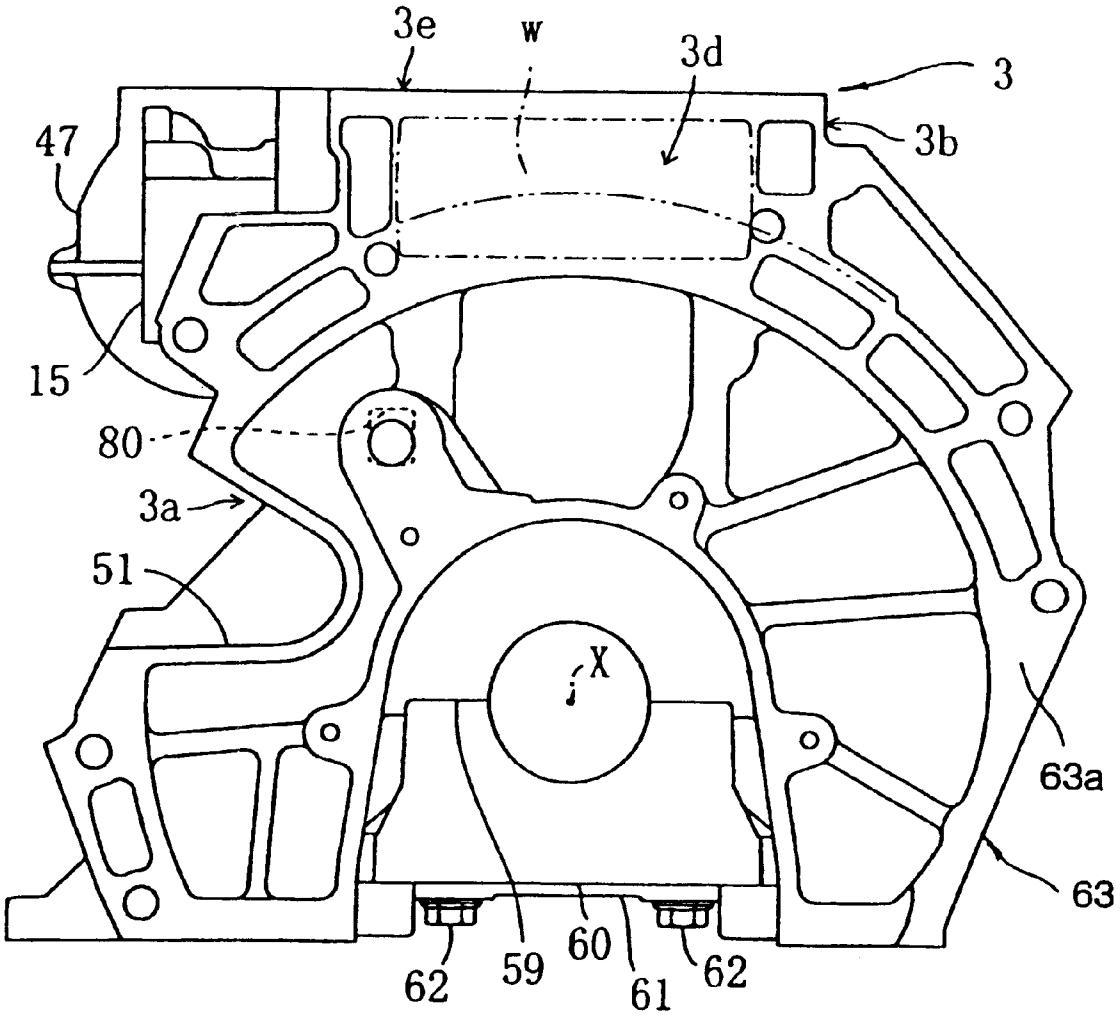
FIG. 7 is a rear end view of the cylinder block.
Figure 8:
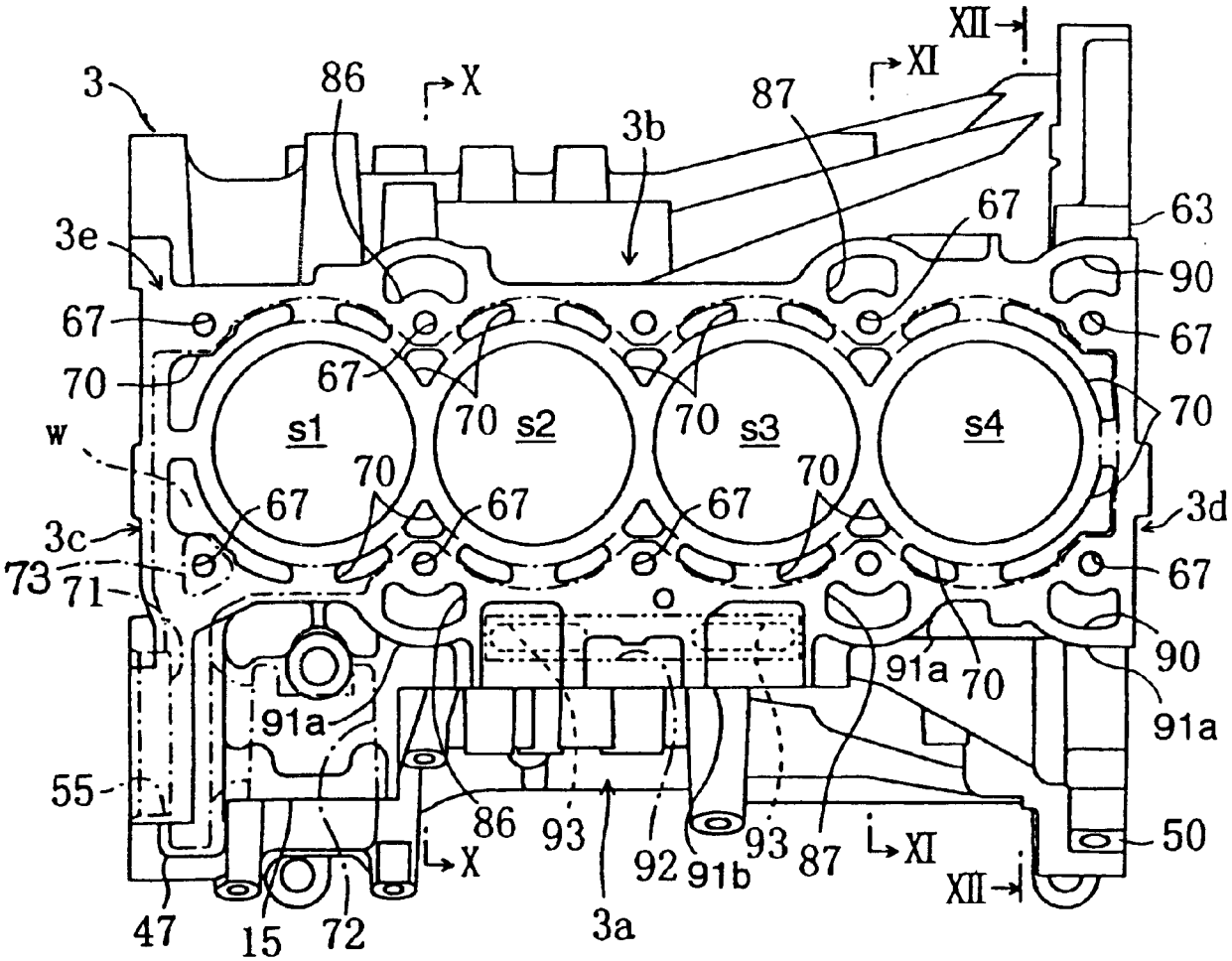
FIG. 8 is a top view of the cylinder block.
Figure 9:
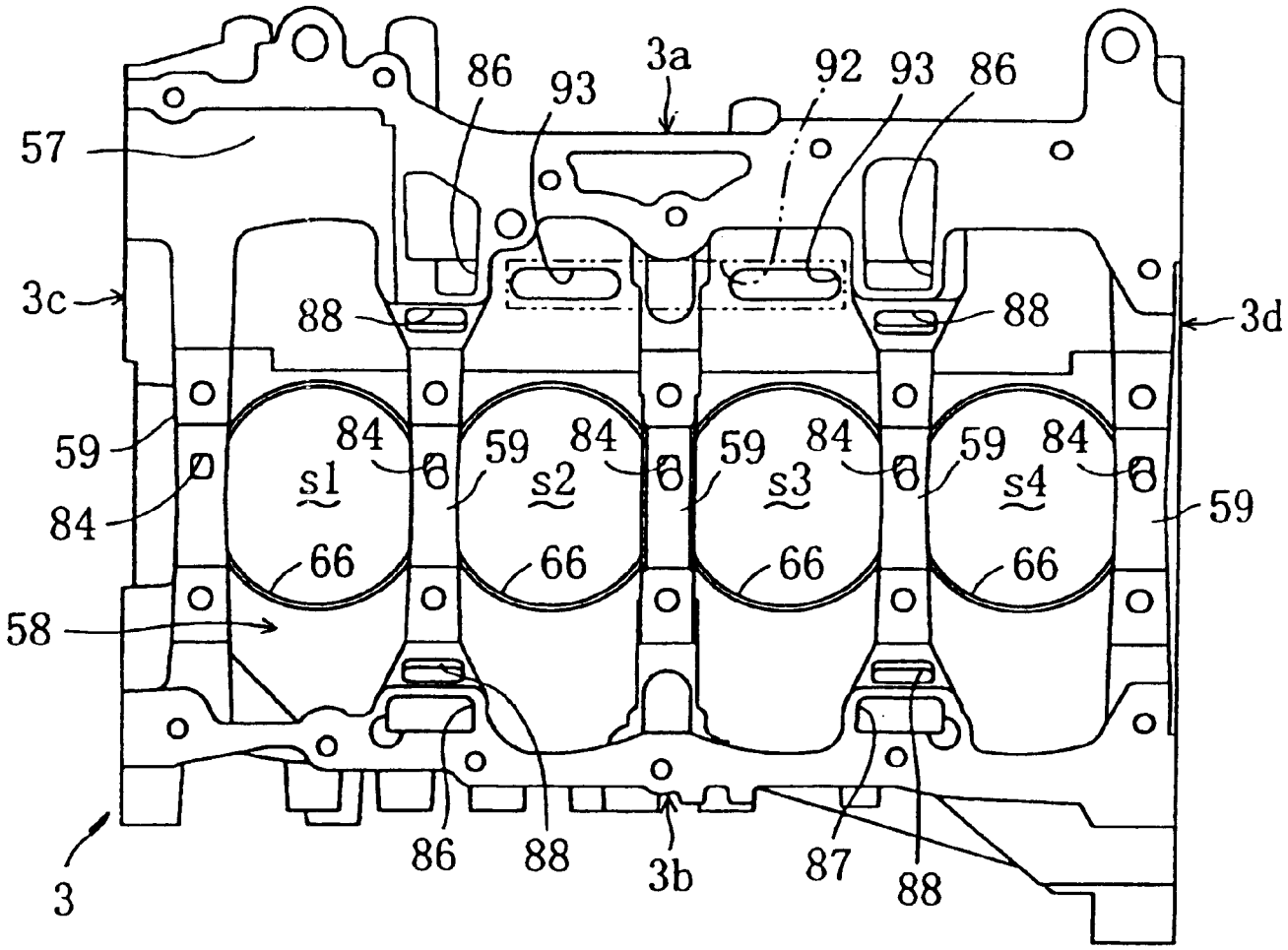
FIG. 9 is a bottom view of the cylinder block.

As shown in FIG. 7, the cylinder block 3 at the rear end is formed with a generally circular-shaped flange as a coupling mount 63 to which the automatic transmission is mounted. This mounting flange is made up of two mating flange halves. One of the mating flange halves is formed as part of the rear end wall 3*d* of the cylinder block 3 that has a generally circular-arcuate configuration. Although not shown in FIG. 7, another mating flange half is formed as part of the oil pan 6 that is attached to the bottom of the cylinder block 3. Specifically, as shown in FIGS. 8 and 9, each of the intake side wall 3*a* and the exhaust side wall 3*b* of the cylinder block 3 widens toward the rear end so as to provide the cylinder block 3 with a generally cone-shaped configuration. The rear end wall 3*d* of the cylinder block 3 is formed with a mating mount half 63*a* having a generally circular-arcuate configuration. The oil pan 6 at the rear end is formed in a circular-arcuate configuration as another mating flange half When the oil pan 6 is attached to the cylinder block 3, the generally circular-shaped flange 63 is completed by the two mating flange halves at the rear end of the cylinder block 3. The automatic transmission is attached to the cylinder block 3 by bolting a generally circular flange of an automatic transmission casing to the generally circular flange of the cylinder block 3. In this instance, the generally circular flange of the cylinder block 3 is such as to locate the top thereof below the top deck 3*e* of the cylinder block 3 so as to locate the top of the automatic transmission casing below the top deck 3*e* of the cylinder block 3.

The cylinder block 3 at the rear end wall 3*d* is formed with a groove along the pit 51 for receiving the pinion of the starter motor 12. As shown in FIG. 2, the configuration of the pit 51 that opens ranging at least from the intake side wall 3*a* to the rear end wall 3*d* as was previously described makes it possible to fastening a fastening bolt 65 to the drive plate 45 practically checking a location of the drive plate 45 in the pit. This leads to easy work of coupling the automatic transmission to the engine 1. As seen in FIGS. 8 and 9 showing the top of the cylinder block 3 and the bottom of the cylinder block 3, respectively, the cylinder block 3 is formed with four bores for the cylinders s1–s4 that are arranged in a straight raw. A liner ring 66 made of cast iron is press-fitted in each of the cylinders s1–s4 (see FIG. 9). The cylinder block 3 at the top deck 3*e* is formed with ten head bolt holes 67 in which head bolts are fastened to install the cylinder head 4 to the cylinder block 3. Four head bolt holes 67 are arranged around each of the cylinders s1–s4 at regular angular separations as viewed from the top.

Figure 10:
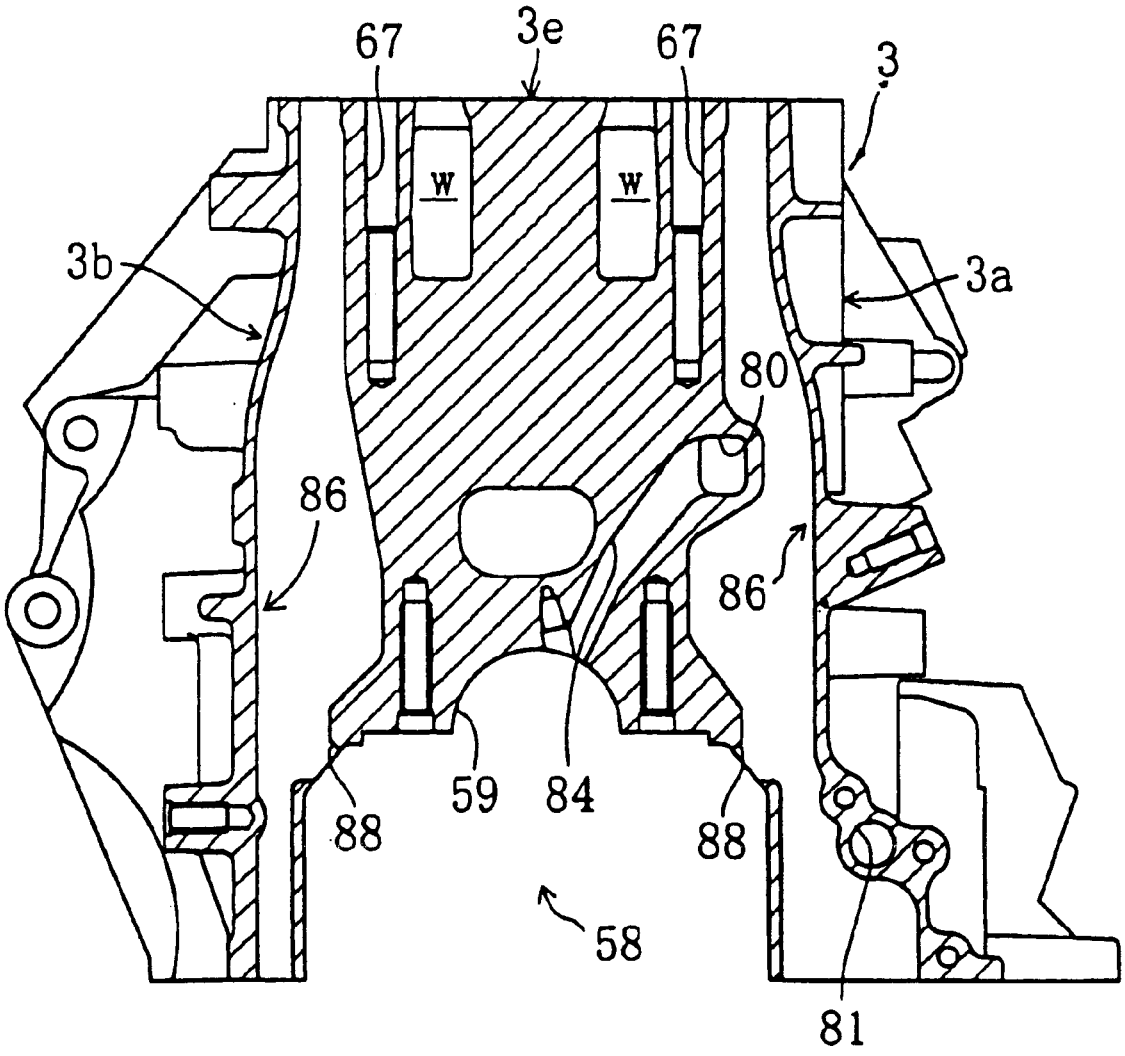
FIG. 10 is a cross-sectional view taken along line X—X of FIG. 4 or FIG. 8.
Figure 11:
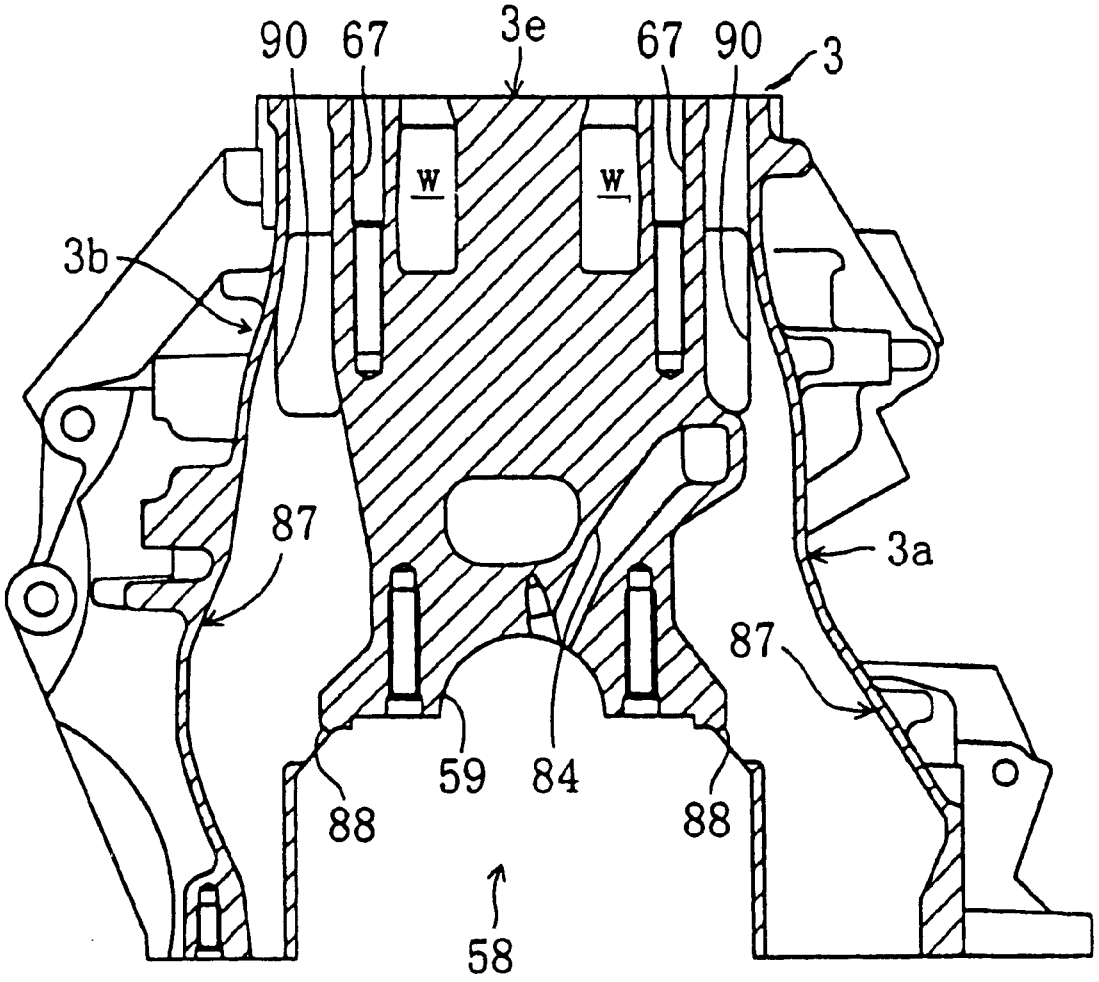
FIG. 11 is a cross-sectional view taken along line XI—XI of FIG. 4 or FIG. 8.
Figure 12:
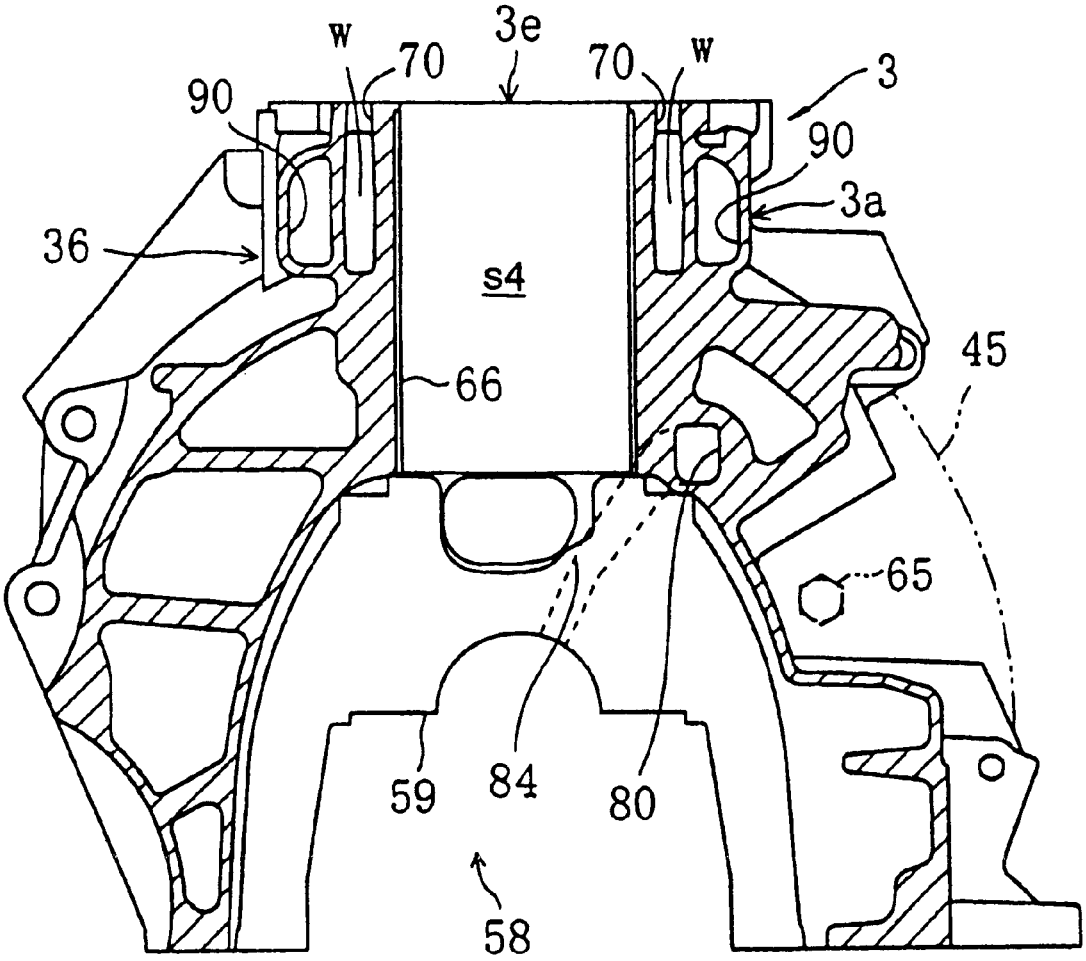
FIG. 12 is a cross-sectional view taken along line XII—XII of FIG. 4 or FIG. 8.
Figure 13:
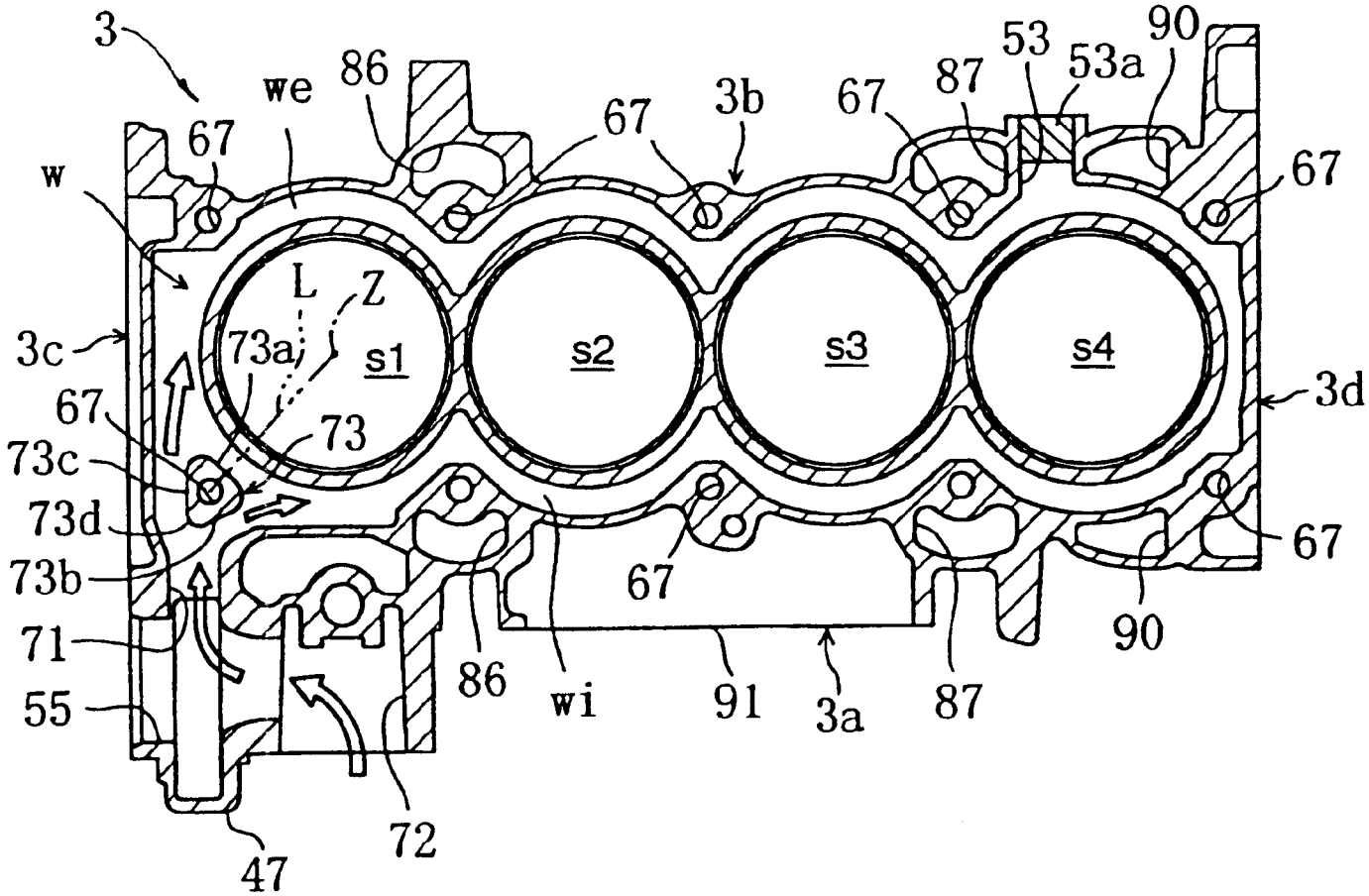
FIG. 13 is a cross-sectional view taken along line XIII—XIII of FIG. 4.

FIGS. 10 to 13 are cross-sectional views showing the structure of water jacket w formed in the cylinder block 3. As shown, the water jacket w is provided so as to surround the straight row of four cylinders s1–s4. Specifically, the water jacket w is formed such as to extend from the front end to the rear end of the cylinder block 3 and to wind along the cylinders s1–s4 on each of opposite sides of the straight row of cylinders s1–s4. Part of the water jacket w close to the intake side wall 4*a* (which is hereafter referred to as an intake side water jacket wi) and part of the water jacket w close to the exhaust side wall 3*b* (which is hereafter referred to as an exhaust side water jacket we) are communicated with each other on the right and rear ends of the cylinder block 3. The cylinder block 3 at the top deck 3*e* is formed with water supply ports 70 at separations along the water jacket w as seen in, in particular, FIGS. 8 and 12. These water supply ports 70 are different in shape and penetrate the top deck 3*e* to the water jacket w. Cooling water flows into a water jacket of the cylinder head 4 from the water jacket w through the water supply ports 70. The water jacket w is dug down almost half the length of the cylinder bore as shown in FIG. 12. Each of the head bolt holes 67 has a depth greater than that of the water jacket w as shown in FIGS. 10 and 11. As the cylinder block 3 made of aluminum alloy is superior in heat release performance to a cylinder block made of cast iron, if the cylinder block 3 made of aluminum alloy is provided with a water jacket formed such as to be deep in excess, the interior of the combustion chamber in each of the cylinders s1–s4 grows too cold. This is accompanied by aggravation of thermal efficiency of the engine 1. For this reason, the water jacket w is formed such as to have a depth smaller than the head bolt holes 67. On the other hand, If making a path length of a water guide passage before the water jacket w as short as possible in consideration of a comparatively small depth of the water jacket w, it is practically essential to locate the water pump housing 47 and the thermostat housing 15 in close proximity to the top deck 3*e* of the cylinder block 3 like the engine 1 of this embodiment. In light of the water pump 10 that is driven by the V-belt 8, the water pump housing 47 is located closely to the front end wall 3*c* of the cylinder block 3. As seen in FIGS. 6, 8 and 13, there is a water guide passage 71 formed in the cylinder block 3 at the front end wall 3*c* such as to surround the pump chamber 55 in the water pump housing 47. Cooling water supplied from a radiator and discharged from the water pump 10 flows passing through the water guide passage 71 and enters the water jacket w at the juncture between the intake side and exhaust side water jackets wi and we in close proximity to the front end wall 3*c* of the cylinder block 3. This water guide passage 71 comprises upstream portion that surrounds the pump chamber 55 (see FIG. 6) so as to be in communication with the pump chamber 55 and has a cross section that gradually increases in sectional area from the upstream end to the downstream end. The water guide passage 71 has a downstream end opening 71*a* (see FIG. 4) that has a thin rectangular shape extending in a direction of depth of the water jacket w. In other words, the water guide passage 71 at the downstream end opens into the water jacket w over between the top and bottom of the water jacket w. This configuration of the water guide passage 71 causes the cooling water to flow smoothly in the water guide passage 71 and to satisfactorily enter the water jacket. In addition, the configuration of the downstream end opening 71*a* in which the opening is thin and elongated between the top and bottom of the water jacket w prevents the cylinder block from being increased in length while making the opening as large in sectional area as possible.

The pump chamber 55 of the water pump housing 47 is configured such as to extend into the interior of the thermostat housing 15 and to be in communication with a thermostat chamber 72 of the thermostat housing 15 in which a thermostat (not shown) is received. When an impeller of the water pump 10 rotates, the cooling water from the radiator is drawn into the pump chamber 55 through the thermostat chamber 72 and then discharged radially out of the pump chamber 55. Thereafter, the cooling water flows passing through the water guide passage 71 and enters the water jacket w at the front end juncture between the intake side and exhaust side water jackets wi and we. As shown in FIG. 13, the cylinder block 3 is provided with a triangular pillar 73 disposed in close proximity to the downstream end opening 71*a* and having a vertical length approximately equal to the depth of the water jacket w or extending along the full depth of the water jacket w. This director pillar 73 operates, on one hand, as a cylinder head installation boss into which one of head bolts is fastened in order to install the cylinder head 4 to the cylinder block 3 and, on the other hand, as water stream director means for dividing a cooling water stream reaching the downstream end opening 71*a* of the water guide passage 71 into two streams, one of which enters the intake side water jacket wi and another of which enters the exhaust side water jacket we. The director pillar 73 has three side walls, namely first, second and third side walls 73*a*, 73*b* and 73*c* and is formed with a center bolt hole 67 that is one of the ten head bolt holes 67. The director pillar 73 is configured so that first side wall 71*a* that is adjacent to the first or foremost cylinder s1 is almost perpendicular to a straight line L passing both vertical center axis z of the first cylinder si and vertical center axis of the center bolt hole 67. In other words, the side wall 73*a* of the director pillar 73 is almost parallel to the external wall of the first cylinder s1, so that a smooth stream of cooling water is created between the director pillar 73 and the first cylinder s1. As a result, the cooling water cools the first cylinder s1 successfully uniformly. In addition, the triangular pillar 73 is such that the cross section has a comparatively long distance in a radial direction of the first cylinder s1, so as to have a sufficiently high bending rigidity. The director pillar 73 is located so as to place the edge line 73*d* of the director pillar 73 between the second and third side walls 73*b* and 73*c* that intersects the straight line L in overlapping position with a plane in which the downstream end opening 71*a* of the water guide passage 71 opens as viewed in a direction of the cooling water stream (shown by arrows) in the water guide passage 71. By virtue of the director pillar 73 thus located and configured, the cooling water is directed partly to the intake side water jacket wi by one of the opposite side walls 73*b* and 73*c* with respect to the edge line 73*d*, namely the side wall 73*b* in this embodiment, and partly to the exhaust side water jacket we by another of the opposite side walls 73*b* and 73*c* with respect to the edge line 73*d*, namely the side wall 73*c*. In this instance, the width of passage between the front end wall 3*c* of the cylinder block 3 and the side wall 73*c* of the director pillar 73 that is adjacent to the front end wall 3*c* of the cylinder block 3 is made greater than the width of passage between the intake side wall 3*a* of the cylinder block 3 and the side wall 73*b* of the director pillar 73 that is adjacent to the intake side wall 3*a* of the cylinder block 3, as viewed from the top of the cylinder block 3. This structure of passage around the director pillar 73 directs a sufficient quantity of cooling water to the exhaust side water jacket we that is apt to become a comparatively high temperature. As a result, the cylinder block 3 is entirely and satisfactorily cooled. As described above, the cooling water entering the water jacket w is appropriately and smoothly distributed into the intake side water jacket wi and the exhaust side water jacket we. The cooling water flowing in each of the intake side and exhaust side water jackets wi and we is distributed into the water jacket of the cylinder head 4 through the water supply ports 70. The cooling water flowing the water jacket w of the cylinder block 3 and the water jacket of the cylinder head 4 are drained through the drain pipe 17*a* of the drain structure 17 at the rear end of the engine block.

Conventionally, low pressure metal casting in which molten metal is poured into a casting mould under a specified level of pressure is employed to form the cylinder block 3 made up of aluminum alloy. In the low pressure metal casting, in order to provide the cylinder block 3 with hollow-spaces as water jackets, a collapsible core block such as a sand block and a salt block is used. Such a collapsible core block is generally supported in the casting mould by means of engagement between projections formed on the casting mould and holes formed in the core block or by engaging a pin stuck into the core block with holes formed in the casting mould. However, because these ways of supporting the core block are troublesome and need time and effect, there has still been a demand for an easy reliable way of supporting the core block In this regard, the problem is cleared in the engine block of the present invention by directing a focus to the structure that there is an opening in communication with the water jacket w in each of the exhaust side wall 3*b* and the front end wall 3*c* of the cylinder bloc 3. That is, a core block for providing the opening is formed with projections as integral parts that are engageable with a casting mould so that the core block is directly supported by the casting mould through engagement of the projections with the casting mould. Specifically, as was previously described, the cylinder block 3 has a communication opening (reference number is requested), through which the pump chamber 55 for receiving the water pump 10 communicates with the water guide passage 71, in the front end wall 3*c* as shown in FIG. 6 and the heater bore 53, which is in communication with the exhaust side water jacket we, in the exhaust side wall 3*b* as shown in FIG. 5. According to this arrangement of hollow spaces for these opening and bore in the cylinder block 3, a core block for the water jacket w is formed, as its integral parts, with a core block for providing the communication opening (reference number) and a core block for providing the heater bore 53, as well as core blocks for providing the pump chamber 55 and the water guide passage 71.

Figure 14:
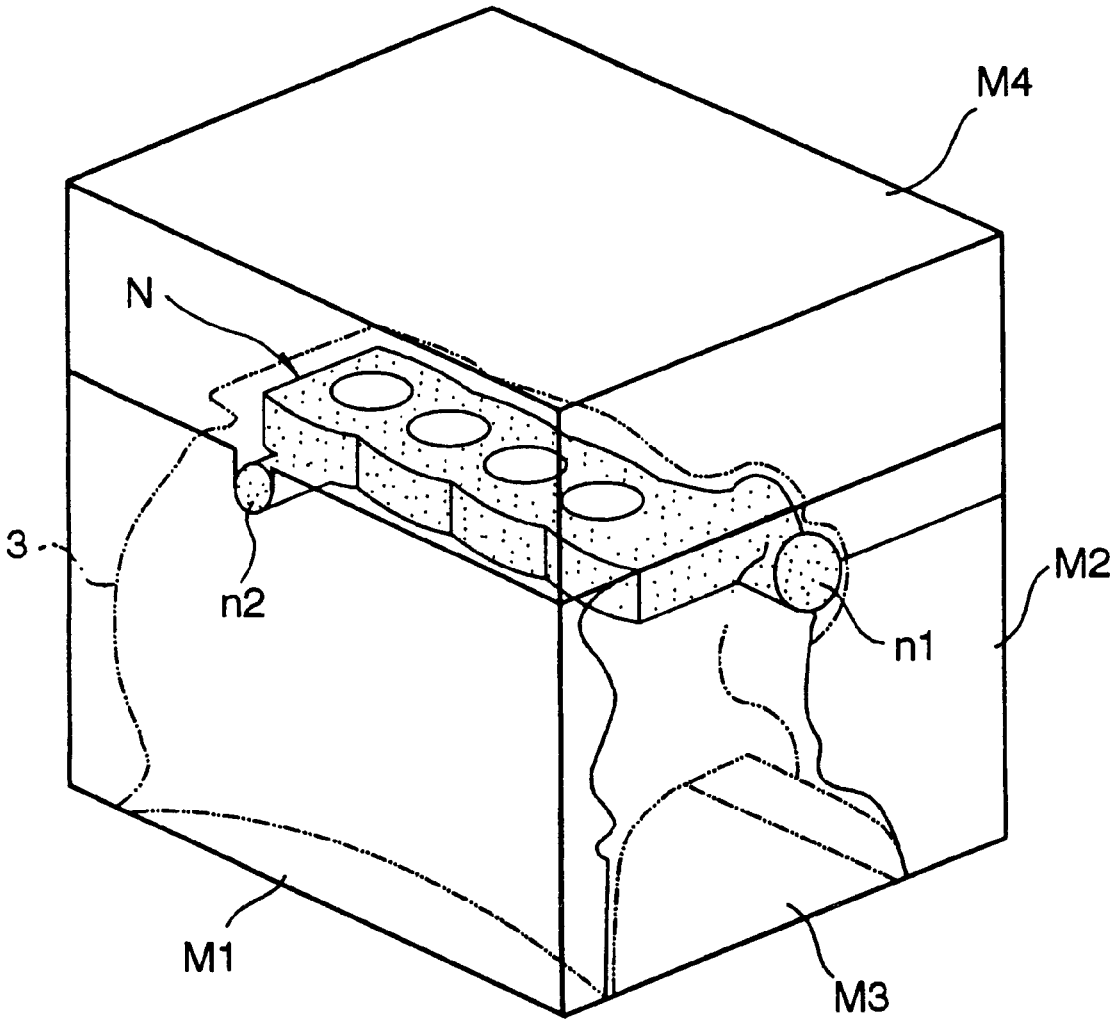
FIG. 14 is a schematic view diagrammatically showing a supporting structure for supporting a water jacket core block in a cylinder block casting mould.
Figure 15A:
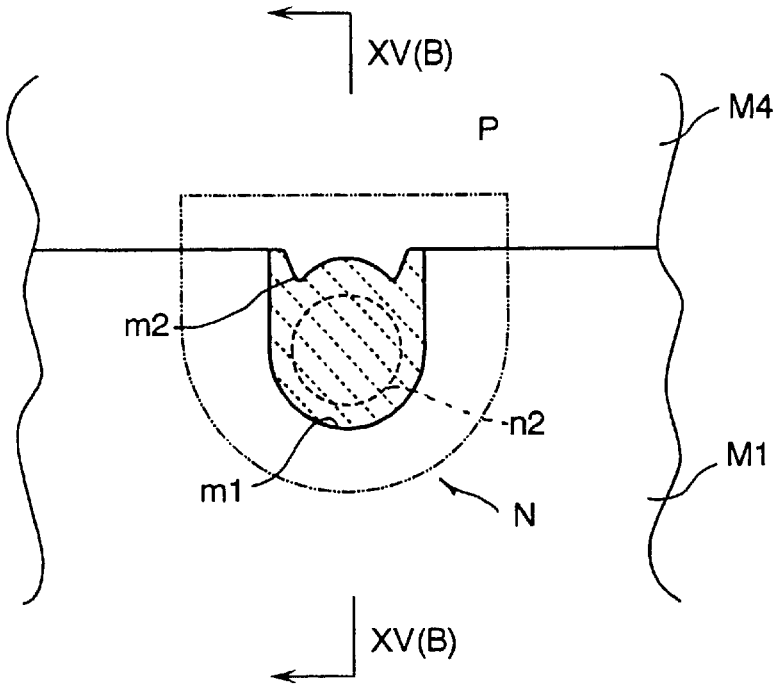
FIG. 15(A) is an enlarged schematic view showing a supporting structure for supporting a second projection of the water jacket core block.
Figure 15B:
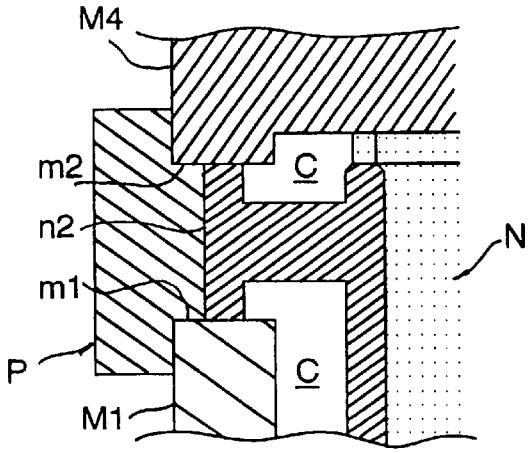
FIG. 15(B) is a cross-sectional view taken along line XV(B)—XV(B) of FIG. 15(A).

As diagrammatically shown in FIG. 14, in a preparatory step, a casting mould is assembled by installing an intake side mould component M1, an exhaust side mould component M2, a front end mould component M3, a rear end mould component (not shown) and a bottom mould component (not shown) to one another. After putting a core block N on the bottom mould component, a top mould component M4 is put onto the casting mould assembly. The core block N is integrally formed with a first projection n1 having the same configuration of the pump chamber 55 and the water guide passage 71 as an integral part at the front end and a second projection n2 having the same configuration of the heater bore 53 as an integral part in a position at a left side thereof adjacent to the fourth cylinder s4. When all of the mould components are properly and completely assembled to the casting mould, the core block N is held in the casting mould with the top end of the first projection n1 interposed between the exhaust side mould component M2, front end mould component M3 and the top mould component M4 and the top end of the second projection n2 interposed between the intake side mould component M1 and the top mould component M4. As shown more specifically in FIGS. 15(A) and 15(B) showing the holding structure between the core block N at the second projection n2 and the casting mould, the intake side mould component M1 is formed with a pit m1 having a semi-circular bottom, and the top mould component M4 is formed with a presser foot m2 that is located within the pit m1 when the top mould component M4 is on the intake side mould component M1. On the other hand, the first projection n2 of the core block N has a generally cylindrical arm extending laterally from the side of the core block N and an end flange at the end of the cylindrical arm. The end flange has such a configuration as to fit in an opening formed not in a circle but in an escutcheon configuration between the pit m1 and the presser foot m2, in other words, to be firmly interposed between the pit m1 and the presser foot m2. Further, a striking plate P pushes the projection n2 of the core block N from the outer side of the casting mould so as to reliably hold the core block N in the casting mould.

Pressurized molten aluminum is poured in the casting mould thus constructed through a pour gate at a bottom of the casting mould. Then the molten aluminum is filled in a cavity C having the same configuration of the cylinder block 3. According to use of the casting mould, as shown in FIG. 5, the heater bore 53 is provided with a boss having a cross section that is not shaped in a circle but in an escutcheon configuration. In addition, the holding structure eliminates special parts that are conventionally necessary to hold the core block in the casting mould and provides simple and timesaving work of assembling the casting mould including the core block. This leads to a cost reduction of manufacturing the cylinder block 3.

The structure of oil passage of the cylinder block 3 will be hereafter described in detail with reference to FIGS. 4, 6 and 9 to 12. As shown, the cylinder block 3 has a main oil gallery 80 and first to third oil feed passages 81 to 83, all of which are formed in the intake side wall 3*a*. The main oil gallery 80 extends straight from end to end of the cylinder block 3. An engine oil discharged from the oil pump 56 is introduced to the oil filter 13 through the first oil feed passage 81 and then into the main oil gallery 80 through the second oil feed passage 82 after filtration by the oil filter 13. The first oil feed passage 81 at the downstream end opens in the fitting mount 49 and is in communication with an inlet port of the oil filter 13. The second oil feed passage 82 at the upstream end opens in the fitting mount 49 and is in communication with an outlet port of the oil filter 13. The third oil feed passage 83 is formed in the front end wall 3*c* and extends from side to side of the cylinder block 3. On the other hand, while the main oil gallery 80 at upstream and downstream ends is closed by plugs (not shown), respectively, it is in communication with the third oil feed passage 83 as shown in FIG. 6. The third oil feed passage 83 distributes partly the engine oil to a hydraulic tensioner (not shown) operative to regulate tension of the timing chain. This third oil feed passage 83 may be formed by drilling the cylinder block 3 from the intake side wall 3*a*. The third oil feed passage 83 at an end opens in the intake side wall 3*a* but is closed by a plug (not shown).

As shown in FIGS. 9 to 12, there are oil distribution passages 84 branching off from the main oil gallery 80. These oil distribution passages 84 have a comparatively large diameter and lead to the main bearings 59, respectively, so as to supply the engine oil for lubrication. Although not shown, an oil feed passage branches off from the main oil gallery 80 and extends to the cylinder head 4 so that the engine oil is partly introduced into the cylinder head 4. This oil feed passage is provided with a throttle so that, while the main bearings 59 are supplied with a sufficient amount of the engine oil, the valve drive mechanism installed to the cylinder head 4 is supplied with a sufficient amount of the engine oil.

The engine oil is returned to the oil pan 6 from various sliding parts such as the main bearings 59 of the engine 1 through an oil return passage. The engine oil that is supplied to, for example, the main bearings 59 from the main oil gallery 80 and comes out of the main bearings 59 enters the crankcase 58 and then seeps out of the sliding parts and drops directly in the oil pan 6. On the other hand, the engine oil that is supplied to and comes out of sliding parts such as bearings of the camshaft of the valve drive mechanism installed to the cylinder head 4 enters a middle deck of the cylinder head 4 and then is directed to the top of the cylinder block 3 through an oil return port that extends to the bottom of the cylinder head 4. The engine oil on the top of the cylinder head 4 further enters oil return passages 86 and 87 and is returned into the crankcase 58 or the oil pan 6. More specifically, as shown in FIGS. 5 and 6, the cylinder block 3 is formed with front end oil return passages 86 in the front end wall 3*c* thereof. Each of the front end oil return passages 86 extends straight in a substantially vertical direction between the first and second cylinders s1 and s2. Similarly, the cylinder block 3 is formed with rear end oil return passages 87 in the rear end wall 3*c* thereof Each of the rear end oil return passages 87 extends straight in a substantially vertical direction between the third and fourth cylinders s3 and s4. As shown in FIGS. 10 and 11, each of these oil return passages 86 and 87 opens in the top deck 3*e* and the bottom of the cylinder block 3. This arrangement of the oil return passage 86 and 87 in which the oil return passage extends straight between each adjacent cylinders s1 and s2 or s3 and s4 provides a smooth stream of the engine oil in each oil return passage, i.e. reliable return of the engine oil to the oil pan 6 from the cylinder head 4. In addition, this arrangement of the oil return passages 86 and 87 causes the engine oil to seep out of the sliding parts and drop into the oil pan 6 in a position between the adjacent cylinders, so that counterweights of the crankshaft 2 splash about only a small amount of the engine oil.

The oil return passage 86, 87 is formed with a port 88 near the downstream end. This port 88 opens to the crankcase 58 so as to allow the engine oil to return into the oil pan 6 even when the liquid level of the engine oil inclines with respect to the oil pan 6 such that the downstream end opening of the oil return passage 86, 87 goes under the engine oil due to inclination of the engine 1 in the lengthwise direction of the vehicle or due to longitudinal acceleration of the vehicle. This provides the oil return passages 86 and 87 with reliable oil returning performance. The oil return passages 86 in the front end wall 3*c* are configured so that the downstream end opening of the oil return passage 86 close to the intake side wall 3*a* is larger than the downstream end opening of the oil return passage 86 close to the exhaust side wall 3*b*. Similarly, the oil return passages 87 in the rear end wall 3*d* are configured so that the downstream end opening of the oil return passage 87 close to the intake side wall 3*a* is larger than the downstream end opening of the oil return passage 87 close to the exhaust side wall 3*b*. This configurations of the downstream end openings of the oil return passages 86 and 87 prevents or significantly reduces an adverse influence of wind pressure caused by the crankshaft 2 rotating in a clockwise direction on the reliable oil returning performance of the oil return passages 86 and 87 even when the liquid level of the engine oil inclines with respect to the oil pan 6.

The cylinder block 3 is further formed with branch oil return passages 90 in the intake side wall 3*a* and the exhaust side wall 3*b*, respectively. Each of the branch oil return passages 90 branching off from the middle of the rear end oil return passage 87 and extends upper left. This branch oil return passage 90 at the upstream end opens in the top deck 3*e* of the cylinder block 3 (see FIG. 8) such as to be in a position closer to the rear end of the cylinder block 3 than the upstream end opening of the oil return passage 87 and to be in communication with the oil return port that is formed in the cylinder head 4. On the other hand, the branch oil return passage 90 at the downstream end is connected to the rear end oil return passage 87 in close proximity to a position where lower part of the water jacket w is located. This arrangement of the branch oil return passages 90 causes an engine oil stream from the oil return port of the cylinder head 4 to join the oil return passage 87 through the branch oil return passage 90. Accordingly, in the case where the engine 1 is of a longitudinally mounted type, as well as in the case where the engine 1 is of a transversely mounted type, even when the engine 1 inclines so that the rear end is higher in level than the front end, the branch oil return passages 90 prevent the engine oil from staying at the rear end of the cylinder head 4. Each of the oil return passages 86, 87 and 90 has a closed cross section.

As shown in FIG. 8, the cylinder block 3 has external raises 91*a* as wall strengthening parts of the intake side wall 3*a* and the exhaust side wall 3*b*, respectively, which are formed as integral parts of the side walls so as to surround the oil return passages 86, 87 and 90, respectively, at upper portions of the intake side wall 3*a* and the exhaust side wall 3*b* corresponding in position to the water jacket w as shown in FIG. 8. These external raises 91*a* provide the cylinder block 3 with an increased rigidity of the upper portions of the intake side walls 3*a* and the exhaust side walls 3*b* around the oil return passages 86, 87 and 90. One of the external raises 91*a* of the intake side wall 3*a* of the cylinder block 3 that is adjacent to the front end oil return passage 86 continuously leads to the thermostat housing 15 that is formed as integral part of the intake side wall 3*a* of the cylinder block 3. In addition, the cylinder block 3 has intermediate external raises 91*b* as integrally parts of the intake side wall 3*a* and the exhaust side wall 3*b*, respectively. Each of the intermediate external raises 91*b* continuously leads to the opposite external raises 91*a* and is formed with an oil separator chamber 92 therein. That is, in this instance, the cylinder block 3 at the intake side wall 3*a* is provided, in order from the front end to the rear end, with the water pump housing 47, the thermostat housing 15, the external raise 91*a* for the front end oil return passage 86, the intermediate external raise 91*b* and the external raise 91*a* for the rear end oil return passage 87 which are formed as a single continuous part integral with the intake side wall 3*a*. Further, the external raises 91*a* for the branch oil return passage 90 at opposite ends leads to the external raise 91*a* for the rear end oil return passage 87 and the rear end of the cylinder block 3. This structure of the cylinder block 3 strengthens upper portion of the intake side wall 3*a* throughout from the front end to the rear end that receives exciting force most hardly, so as to prevent or significantly reduce wall vibrations of the intake side wall 3*a* that are comparatively low frequency vibrations. As a result, the engine 1 and its associated devices generate only reduced vibration and noises.

In this instance, as shown in FIG. 9, the oil separator chamber 92 is in communication with blow-by gas passages 93 through which blow-by gas is introduced into the oil separator chamber 92 from the crankcase 58. An oil separator separates oil mist from the blow-by gas introduced into the oil separator chamber 92. The blow-by gas is then supplied into the common intake pipe 22 of the intake manifold 7 through a passage (not shown), and the oil mist is returned into the crankcase 58 through the blow-by gas passages 93.

In the structure of the engine block including the water jacket w according to the present invention, cooling water discharged from the water pump 10 that is introduced directly into the water jacket w through the water guide passage 71 is appropriately divided into two streams, one of which enters the intake side water jacket wi and the other of which enters the exhaust side water jacket we, by the triangular pillar 73 as the water stream director means disposed near the interface between the water jacket w and the water guide passage 71. This increases the cooling efficiency of the cylinder block 3. The triangular pillar 73 can be disposed as the cylinder head installation boss in consideration with the cross section so as to have a sufficient length in axial directions of the first or foremost cylinder s1 to which the triangular pillar 73 is adjacent. This sufficiently increases the bending rigidity of the triangular pillar 73 as the cylinder head installation boss and, accordingly, provides the engine 1 with secured reliability. Furthermore, the triangular pillar 73 can be disposed as the water stream director means in an overlapping position between the water guide passage 71 and the water jacket w as viewed in a direction from the front end to the rear end of the cylinder block 3. This is contributory to a shortened length of the cylinder block 3. In addition, the configuration of the downstream end opening of the water guide passage 71 that is thin and extends along the full depth of the water jacket w provides the water guide passage 71 with an improved performance of introducing cooling water into the water jacket w in addition to contribution to a shortened length of the cylinder block 3. In particular, in the embodiment described above, the water pump housing 47 and thermostat housing 15 are located in quite close positions, respectively, to the water guide passage 71 because the water jacket w is comparatively shallow. While on one hand the location of the water pump housing 47 and thermostat housing 15 provides the water guide passage 71 with a more improved performance of introducing cooling water into the water jacket w because a path of cooling water to the water jacket w can be made as short in length as possible, the location of the water pump housing 47 and thermostat housing 15 imposes a constraint on the layout of the water guide passage 71 for avoidance of positional interference of the water guide passage 71 with the water pump housing 47 and thermostat housing 15. Despite of the constraint, while the cylinder block 3 can be shortened in length as described above, the cylinder block 3 can be provided with an improved performance of introducing cooling water into the water jacket w and an improved performance of distributing the cooling water into two divided parts of the waterjacket.

There has been fully disclosed an improved engine body structure. While an illustrative embodiments of the present invention has been disclosed, it is to be understood that variants and other embodiments will be apparent to those of ordinary skill in the art and it is intended that this invention be limited only by scope of the appended claims.

What is claimed is:

1. A structure for an engine block of a reciprocating engine having a cylinder block which is provided with a straight row of cylinders in which pistons are received, respectively, for reciprocating movement, a mount located at a rear end wall of said cylinder block in a lengthwise direction of said engine to which a transmission is mounted, said structure for an engine block comprising:

oil supply means for supplying an engine oil to sliding parts that are installed to said engine block from an oil source means; and oil return means for returning an engine oil to the oil source from the sliding parts, said oil return means comprising:

a plurality of oil return passages formed along said straight row of cylinders in each of opposite side walls of said cylinder block, each said oil return passage extending straight from top to bottom of said cylinder block between adjacent cylinders and having opposite ends opening in top and bottom surfaces of said cylinder block, respectively; and a branch oil return passage branching off from one of said oil return passages that is closest to said rear end wall of said cylinder block, said branch oil return passage extending upwardly obliquely towards said rear end wall of said cylinder block and having an end opening in said top surface of said cylinder block, wherein said end opening of said branch oil return passage is located closer to said rear end wall of said cylinder block than said end opening of said one oil return passage opening in said top surface of said cylinder block.

2. The structure for an engine block as defined in claim 1, further comprising a pit for receiving a pinion of a starter motor therein which is formed so as to open ranging at least from one of said opposite side walls of said cylinder block below said branch oil return passage to said rear end wall of said cylinder block.

3. The structure for an engine block as defined in claim 1, further comprising a water jacket formed in said opposite side walls so as to surround entirely said straight row of cylinders, wherein said branch oil return passage branches off from said one oil return passage near below a bottom of said water jacket.

4. The structure for an engine block as defined in claim 3, further comprising a thermostat housing for receiving a thermostat therein which projects externally from either one of said opposite side walls in a position close to a front end wall of said cylinder block and adjacent to said water jacket.

5. The structure for an engine block as defined in claim 4, wherein said thermostat housing is located adjacent to a foremost one of said oil return passages.

6. The structure for an engine block as defined in claim 5, further comprising an external raise formed on each of said opposite side walls so as to lie adjacent to foremost and rearmost ones of said oil return passages and an external intermediate raise formed on each of said opposite side walls so as to continuously lead to both said external raises adjacent to said foremost and rearmost oil return passages, wherein said external raise adjacent to said foremost oil return passage is integrally continuous to said thermostat housing and said intermediate raise is formed with a chamber for receiving an oil separator therein.

7. The structure for an engine block as defined in claim 1, further comprising a water jacket that surrounds entirely said straight row of cylinders, a water guide passage through which cooling water is introduced into said water jacket at a position adjacent to an extreme one of said cylinders, and director means disposed in said water guide passage near an interface between said water jacket and said water guide passage for directing said cooling water introduced into said water jacket, wherein said director means comprises a generally triangular pillar extending along an approximately full depth of said water jacket and formed with a bolt hole in which a head bolt is fastened to install a cylinder head to said cylinder block therein, said triangular pillar being configured such that a first one of three side walls of said triangular pillar that is adjacent to an external wall of said extreme cylinder is approximately perpendicular to a line passing the vertical center axes of said extreme cylinder and said bolt hole, an edge line between the second and third side walls of said triangular pillar being in said interface, said second side wall directing a cooling water stream partly to said water jacket on one of opposite sides of said straight row of cylinders, and said third side wall directing said cooling water stream partly to said water jacket on another side of said opposite sides of said straight row of cylinders in cooperation with said front end wall of said cylinder block.

8. The structure for a engine block as defined in claim 7, wherein said water guide passage is formed in one of said opposite side walls of said cylinder block to which an intake manifold is installed so that said water jacket is provided with a width that is greater between said third wall of said triangular pillar and said front end wall of said cylinder block than between said second side wall of said triangular pillar and said intake side wall of said cylinder block.

9. The structure for an engine block as defined in claim 7, wherein said cylinder block is composed of an aluminum alloy.

10. The structure for an engine block as defined in claim 9, wherein said bolt hole has a depth greater than said depth of said water jacket.

11. The structure for an engine block as defined in claim 9, wherein said water guide passage has an upstream end in communication with a pump chamber formed in said cylinder block that receives a water pump therein and a downstream end opening to said water jacket, said downstream end extending along said full depth of said water jacket.

12. The structure for an engine block as defined in claim 11, wherein said water guide passage has a cross section that increases in cross sectional area from said upstream end to said downstream end.

13. The structure for an engine block as defined in claim 11, wherein said pump chamber is formed in a water pump housing provided as an external raise of a front portion of said one side wall of said cylinder block corresponding in position to said water jacket, said thermostat housing being formed as an external raise of said one side wall of said cylinder block adjacently behind said water pump housing.

* * * * *